US011456093B2

(12) United States Patent
Kawase

(10) Patent No.: US 11,456,093 B2
(45) Date of Patent: Sep. 27, 2022

(54) WIRE HARNESS PRODUCTION-SUPPORTING DEVICE

(71) Applicant: Hitachi Metals, Ltd., Tokyo (JP)

(72) Inventor: Kenji Kawase, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/918,628

(22) Filed: Jul. 1, 2020

(65) Prior Publication Data

US 2021/0005357 A1 Jan. 7, 2021

(30) Foreign Application Priority Data

Jul. 4, 2019 (JP) ..... JP2019-125242

(51) Int. Cl.
*H01B 13/012* (2006.01)

(52) U.S. Cl.
CPC . *H01B 13/01236* (2013.01); *H01B 13/01209* (2013.01)

(58) Field of Classification Search
CPC ..... H01B 13/01236; H01B 13/01209
See application file for complete search history.

(56) References Cited

U.S. PATENT DOCUMENTS 3,693,228 A * 9/1972 Logan ..... H01B 13/01245 29/56.6
6,101,695 A * 8/2000 Nakamura ..... H01R 43/28 29/748
6,125,532 A 10/2000 Takada
(Continued)

FOREIGN PATENT DOCUMENTS

CN 104071635 A * 10/2014
CN 207742597 U * 8/2018
(Continued)

OTHER PUBLICATIONS

Extended European Search Report dated Oct. 1, 2020 for European Patent Application No. 20183924.8-1201.
(Continued)

*Primary Examiner* — Peter Dungba Vo
*Assistant Examiner* — Jose K Abraham
(74) *Attorney, Agent, or Firm* — McGinn I.P. Law Group, PLLC.

(57) ABSTRACT

A wire harness-producing device configured to produce a wire harness by displaying a wire laying-out image in a full size in a length direction on a plurality of display devices, and laying out electric wires along the wire laying-out image. The wire harness-producing device includes an electric wire-feeding device to allow the electric wires to be manually pulled out, a storage section to store operation recipe information therein, and a displaying control section to perform a displaying control on the display devices. The operation recipe information includes lengths of the electric wires. When each of the electric wires to be laid out is pulled out, the displaying control section displays, on the display devices, a starting end location indicator indicating a location for a front end portion of each of the electric wires having been pulled out, based on the lengths of the electric wires in the operation recipe information.

13 Claims, 19 Drawing Sheets

(56) References Cited

U.S. PATENT DOCUMENTS

| | | | | |
|---|---|---|---|---|
| 6,272,387 | B1 * | 8/2001 | Yoon | B64F 5/40 700/83 |
| 6,615,486 | B1 | 9/2003 | Takada | |
| 8,996,347 | B2 * | 3/2015 | MacLean | H01B 13/01227 703/13 |
| 9,721,702 | B1 * | 8/2017 | Guglielmo | H01B 13/01209 |
| 2003/0163917 | A1 * | 9/2003 | Davidshofer | H01B 13/01227 29/854 |
| 2013/0100277 | A1 * | 4/2013 | Prieto Loefkrantz | G06F 3/011 348/87 |
| 2018/0088550 | A1 * | 3/2018 | Kawase | B23D 33/006 |
| 2018/0137954 | A1 * | 5/2018 | Hasegawa | H01B 13/01209 |
| 2018/0174715 | A1 * | 6/2018 | Porter | H02G 1/1248 |
| 2019/0118741 | A1 | 4/2019 | Kawase et al. | |
| 2020/0082320 | A1 | 3/2020 | Tsunoda | |

FOREIGN PATENT DOCUMENTS

| | | | | |
|---|---|---|---|---|
| EP | 3 301 688 | A1 | 4/2018 | |
| EP | 3594971 | A1 * | 1/2020 | B60R 16/0207 |
| JP | H 10-261328 | A | 9/1998 | |
| JP | 2000-156127 | A | 6/2000 | |
| JP | 2017-220287 | A | 12/2017 | |
| JP | 2018-055974 | A | 4/2018 | |
| JP | 6323523 | B2 * | 5/2018 | B23D 33/006 |
| WO | WO 2018/225467 | A1 | 12/2018 | |

OTHER PUBLICATIONS

Communication Pursuant to Article 94(3) EPC dated Mar. 29, 2022, in corresponding European Patent Application No. 20 183 924.8-1201.

Japanese Office Action dated Jul. 19, 2022, in corresponding Japanese Patent Application No. 2019-125242, with an English translation thereof.

* cited by examiner

FIG. 4

172

| Step No. | ... | FROM | | | | ... | TO | | | | ... | Cable name | Cut Length | Cable P/N No. | X-From | Y-From | X-To | Y-To | ... |
|---|---|---|---|---|---|---|---|---|---|---|---|---|---|---|---|---|---|---|---|
| | | Area | Area Mark Info | End Mark Info | ... | End Mark Info | Area Mark Info | Area | ... | | | | | | | | | | |
| 1 | | | | | | | | | | | | | | | | | | | |
| 2 | | | | | | | | | | | | | | | | | | | |
| 3 | | | | | | | | | | | | | | | | | | | |
| 4 | | | | | | | | | | | | | | | | | | | |
| 5 | | | | | | | | | | | | | | | | | | | |
| ... | | | | | | | | | | | | | | | | | | | |

174

FIG. 14

Scan Traceability Report

Part Number : EH*** Version 01 / 0003 D rawing No. ** File **
Production Id : 681** / 34* / ****** Start 2019/03/04 11:51 Finish 2019/03/04 12:52 Line Line4
Operators : 1.aaaa 2.bbbb 3.cccc
Total 1h 33s

Scanned Data

| Area | Item/Operation | Date | Additional Info | Length | | Scanned | Time[s] | More Info |
|---|---|---|---|---|---|---|---|---|
| | Process | 2019/03/04 12:52 | | | | ***Finish*** | | |
| | Process | 2019/03/04 12:36 | Inspection | | | Finish | 321 | |
| | Process | 2019/03/04 12:31 | Inspection | | | Start | | |
| | ⋮ | ⋮ | ⋮ | | | ⋮ | | |
| C | A:50MN15C | 2019/03/04 12:14 | Wire Conductivity | 55 | 10 | 1.0515E+00 | 30/30 | |
| C | A:50MN15C | 2019/03/04 12:13 | CAB-***-**** | 55 | 10 | 9 | | |
| C | A:50MN15C | 2019/03/04 12:13 | CAB-***-**** | 55 | 10 | | | |
| C | A:50MN15C | 2019/03/04 12:13 | CAB-***-**** | 55 | 10 | Scan | | |
| | ⋮ | ⋮ | ⋮ | | | ⋮ | | |

WIRE HARNESS PRODUCTION-SUPPORTING DEVICE

CROSS-REFERENCE TO RELATED APPLICATION

The present application is based on Japanese patent application No. 2019-125242 filed on Jul. 4, 2019, the entire contents of which are incorporated herein by reference.

BACKGROUND OF THE INVENTION

1. Field of the Invention

The present invention relates to a wire harness producing device.

2. Description of the Related Art

A wire harness designed to be used in a train vehicle such as a train or the like is configured with a plurality of electric wires being bundled together therein. In producing the wire harness, a plurality of operations are performed, such as a wire laying out operation in which each of the plurality of electric wires is cut to a preset electric wire length, and laid out along a full scale wire laying out drawing, an assembling operation in which the electric wires laid out by that wire laying out operation are bundled together to form a bundle of the electric wires, fitted with a component to be attached in a predetermined location thereon, and assembled as the wire harness, and the like (see e.g. JP-A-2018-055974).

Regarding the above wire laying out operation, Patent Document 1 discloses a method of laying out the plurality of electric wires each cut to a preset electric wire length, along a full scale wire laying out image (wire laying out drawing) displayed on a rectangular shape display device. Further, in JP-A-2018-055974, as a method for feeding each of the plurality of electric wires with a preset electric wire length to a work bench on which the wire laying out operation is performed, it is disclosed that each of the plurality of electric wires is automatically pulled out and transferred up to a preset electric wire length by an electric wire transfer robot, and that each of the plurality of electric wires is automatically cut by an electric wire cutting machine.

[Patent Document 1] JP-A-2018-055974

SUMMARY OF THE INVENTION

Now, regarding the method for feeding each of the plurality of electric wires with a preset electric wire length to the work bench, when omitting the electric wire transfer robot in order to reduce the equipment investment cost, feeding each of the plurality of electric wires with a preset electric wire length to the work bench (more specifically, the work surface of the work bench) manually by an operator is considered, which, however, leads to a problem with improving the efficiency of the cutting operation in which each of the plurality of electric wires is cut to a preset electric wire length.

In light of the foregoing, it is an object of the present invention to provide a wire harness producing device, which is designed to allow the cutting operation for each of a plurality of electric wires to be efficiently performed, when each of the plurality of electric wires with a preset electric wire length is fed to a work surface of a work bench manually by an operator.

For the purpose of solving the above-described problem, the present invention provides a wire harness producing device configured to produce a wire harness by displaying a wire laying out image in a full size in a length direction on a plurality of display devices, and laying out electric wires along the wire laying out image, the device comprising: an electric wire feeding device configured to allow the electric wires to be manually pulled out; a storage section configured to store operation recipe information therein as a database configured to be able to identify wire laying out order numbers of the electric wires; and a displaying control section configured to perform a displaying control on the plurality of display devices, with the operation recipe information including electric wire lengths of the electric wires being set for each of the electric wires, so that when each of the electric wires to be laid out is pulled out, the displaying control section displays, on the plurality of display devices, a starting end location indicator indicating a location for a front end portion of each of the electric wires having been pulled out, on the basis of the electric wire lengths of the electric wires being set in the operation recipe information.

Points of the Invention

The present invention allows the cutting operation for each of the plurality of electric wires in the wire harness producing device to be efficiently performed, when each of the plurality of electric wires with a preset electric wire length is fed to a work surface of a work bench manually by an operator.

BRIEF DESCRIPTION OF THE DRAWINGS

FIG. 4 is a diagram showing one example of operation recipe information.

FIG. 14 is a diagram showing one example of operation history information.

DETAILED DESCRIPTION OF THE PREFERRED EMBODIMENTS

Embodiment

An embodiment of the present invention will be described below in conjunction with the accompanying drawings.

Figure 1:
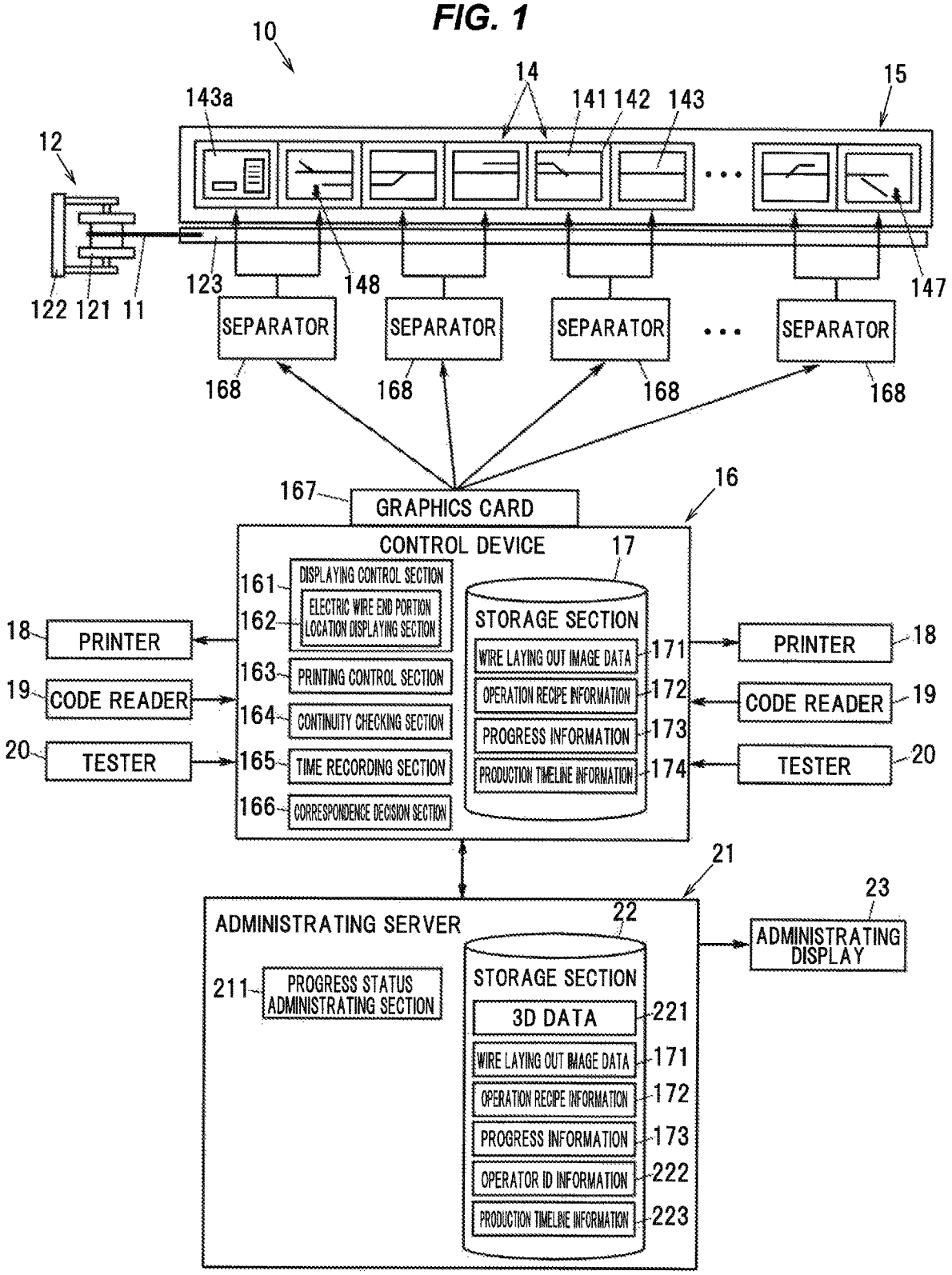
FIG. 1 is a schematic configuration diagram showing a wire harness producing device according to one embodiment of the present invention.

FIG. 1 is a schematic configuration diagram of a wire harness producing device 10 according to the present embodiment. A wire harness to be produced in the present embodiment is designed to be used in, for example, wiring between devices in a train vehicle.

As shown in FIG. 1, the wire harness producing device 10 is a device configured to produce the wire harness by arranging a plurality of rectangular shaped display devices 14 end to end in one row substantially horizontally in a direction from a left-hand side toward a right-hand side, each display device 14 configured to include each rectangular shaped display portion 141 and each bezel portion 142 arranged in such a manner as to surround a periphery of the display portion 141, displaying a wire laying out image (a wire laying out drawing) 143 in a full size in a length direction (in FIG. 1, in the direction from the left-hand side toward the right-hand side) on the plurality of display devices 14 arranged end to end in one row, and laying out each of a plurality of electric wires 11 each cut to a preset electric wire length, along the wire laying out image 143.

The wire harness producing device 10 includes an electric wire stocking portion 12 configured to stock each of the plurality of electric wires 11 to be used in the wire harness to be produced, a work bench 15, which is configured so that the plurality of display devices 14 are arranged end to end in one row substantially horizontally, and a control device 16 configured to perform a displaying control on the plurality of display devices 14, and the like.

The plurality of electric wires 11 are each being configured as a linear shape conductor coated with an electrical insulating member around its outer periphery, but each of the plurality of electric wires 11 may, as with a LAN cable, integrally be configured in such a manner that a plurality of the linear shape conductors are coated with the electrical insulating members around their outer peripheries respectively, and then covered together with an outer sheath therearound. Here, the electrical insulating members are made of an electrically insulative resin and may be configured as one layer or a plurality of layers. The outer sheath may be formed by solid extrusion in such a manner as to impregnate the spaces between the electrical insulating members, or may be formed in a tubular shape.

In the present embodiment, the electric wire stocking portion 12 is configured to be used in the wire harness to be produced, and is configured as a place where each electric wire 11 to be cut to a preset electric wire length is stocked by being wound around a reel 121 in a drum shape, with the electric wire stocking portion 12 being configured in such a manner as to allow a front end portion of that electric wire 11 wound in a drum shape to be manually pulled out toward the tray 123. More specifically, the electric wire stocking portion 12 is configured to include, for example, the reel 121 with the electric wire 11 being wound therearound, and a supporting member 122 configured to pivotably support the reel 121. The reel 121 is fitted with an electric wire identification code (not shown) configured to identify a type of the electric wire 11 being wound therearound.

An upper surface of the work bench 15 is provided with the plurality of display devices 14 arranged end to end in one row substantially horizontally thereon, and the upper surface of the work bench 15 is a rectangular shaped flat surface in a plan view, and not only serves as a display surface on which images of each kind such as the wire laying out image 143 and the like are to be displayed, but also serves as a work surface for an operator to perform operations of each kind (the previously mentioned wire laying out operation, the previously mentioned assembling operation, and the like). Note that, in the case of the wire harness according to the present embodiment, since the wire harness is designed for a train vehicle, its length is very long, e.g., 30 m. In light of the foregoing, the work bench 15 according to the present embodiment is configured in such a manner that 24 of the display devices 14 are arranged end to end in one row.

Note that the number of the display devices 14 to be arranged on the work bench 15 is not limited to the above number. Further, the number of the work benches 15 may also be one as in the present embodiment, or the work bench 15 may be constituted by a plurality of work benches arranged end to end in one row. It should be noted, however, that, when the work bench 15 is constituted by a plurality of work benches, the number and arrangement of the display devices 14 and transparent protecting covers 144 therefor, which will be described later, may be adjusted so that it is possible to disjoin (separate) those display devices 14 and those transparent protecting covers 144 between adjacent ones of the work benches 15. Employing the foregoing configuration has a facilitating effect on altering the layout of a production area within a factory.

Further, the arrangement of the display devices 14 is also not limited to that shown in FIG. 1 (the configuration in which the display devices 14 are arranged end to end in one row in a straight line shape), but can be appropriately altered according to the shape of the wire harness to be produced. For example, the display devices 14 may be arranged in rows and columns in a matrix, or may be arranged end to end in one row in an L shape, a U shape, or a W shape. That is, since the above-described degree of freedom of the arrangement of the display devices 14 can be determined, based on considerations of various factors such as the length of the wire harness to be produced, the size of the production area within the factory, the arrangement of operators, and the like, it is very effective in improving the efficiency of the production of the wire harness.

Figure 2A:
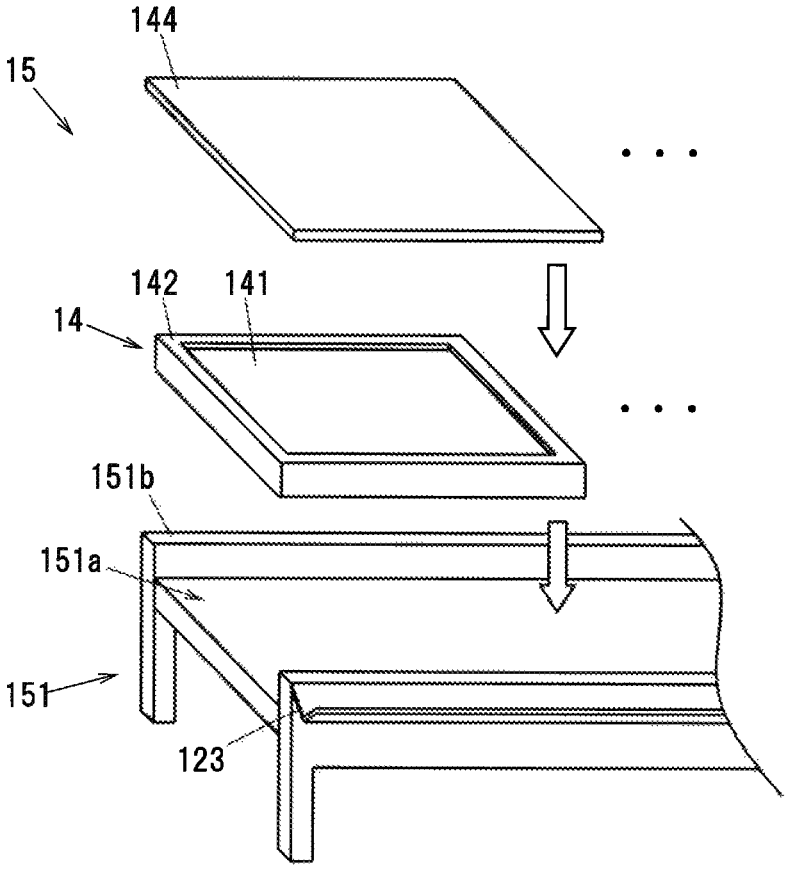
FIG. 2A is an exploded perspective view showing a work bench.
Figure 2B:
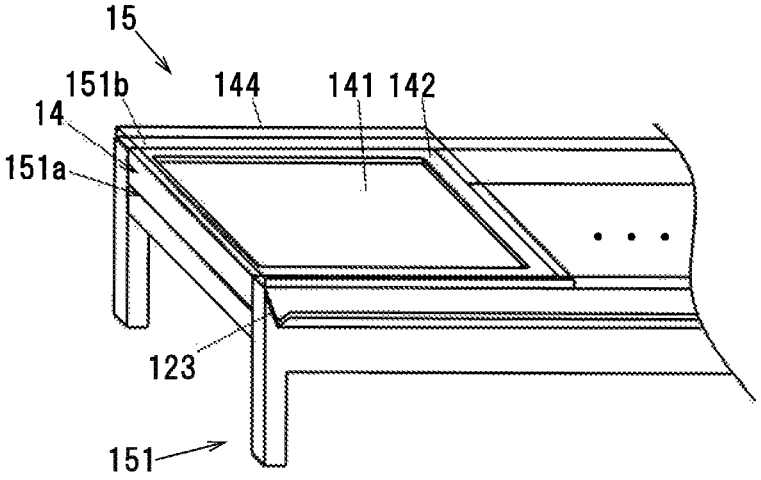
FIG. 2B is a perspective view showing that work bench.

The display devices 14 are made of, for example, a liquid crystal display or the like. As shown in FIGS. 2A and 2B, the work bench 15 is configured to include a frame 151 having a recessed receiving portion 151*a* for receiving the display devices 14 therein, and is constructed by receiving the display devices 14 in the receiving portion 151*a* from above the frame 151. The plurality of display devices 14 are provided with plate-shaped transparent protecting covers 144, respectively, thereon for protecting the respective display portions 141 of the plurality of display devices 14. The transparent protecting covers 144 are made of a transparent member such as an acrylic or the like.

Further, on the transparent protecting covers 144 provided on the plurality of display devices 14, the electric wires 11 each having been pulled out from the electric wire stocking portion 12 and cut to a preset electric wire length are laid out in such a manner as to follow the wire laying out image 143 displayed on the plurality of display devices 14, and those laid out electric wires 11 are appropriately subjected to a tape wrapping, a protective material mounting, and the like, so as to be bundled as the wire harness. That is, when the transparent protecting covers 144 are provided on the plurality of display devices 14 respectively, their upper surfaces serve as the work surface of the work bench 15.

Also, the transparent protecting covers 144 are provided on the plurality of display devices 14, respectively, in such a manner as to cover uneven surfaces between the respective display portions 141 and the respective bezel portions 142 of the plurality of display devices 14. The transparent protecting covers 144 serve to protect the respective display portions 141 of the plurality of display devices 14 from being damaged, and to prevent the electric wire 11 to be laid out from being damaged due to interfering with the uneven surfaces between the respective display portions 141 and the respective bezel portions 142 of the plurality of display devices 14.

The plurality of display devices 14 may be provided with one transparent protecting cover 144, but in this case, in the event of damage to the one transparent protecting cover 144, replacing the one transparent protecting cover 144 is wasteful, or in the event of a fault in the display devices 14, replacing the display devices 14 is time consuming. In light of the foregoing, in the present embodiment, the transparent protecting covers 144 are each individually being provided for each of the plurality of display devices 14. The transparent protecting covers 144 can be detached upward from the display devices 14. By detaching the transparent protecting covers 144 from the display devices 14, the display devices 14 can also be detached upward from the frame 151 of the work bench 15. Thus, even when the work space is narrow, the transparent protecting covers 144 or the display devices 14 can easily be replaced. That is, since the transparent protecting covers 144 and the display devices 14 are configured to be detachable (replaceable) from above the upper surface of the receiving portion 151*a* on the work bench 15, when the work benches 15 are arranged in a plurality of rows in the production area within the factory, even if the passage widths (work spaces) between the work benches 15 are narrowed, there is a facilitating effect on the replacing operation for the transparent protecting covers 144 or the display devices 14. Note that even when the plurality of display devices 14 are arranged in a matrix, the transparent protecting covers 144 can be applied thereto.

The lengths of the transparent protecting covers 144 in a direction of the arrangement of the plurality of display devices 14 arranged end to end in one row are designed to be substantially equal to those of the plurality of display devices 14. Further, the widths of the transparent protecting covers 144 in a width direction perpendicular to the direction of the arrangement of the plurality of display devices 14 arranged end to end in one row are configured to be slightly larger than those of the plurality of display devices 14. The transparent protecting covers 144 are fixed to the frame 151 of the work bench 15 by fixing respective two projecting end portions of the transparent protecting covers 144 being projected from the plurality of display devices 14 in the width direction of the plurality of display devices 14 to two edge portions 151*b* of the frame 151 with screws or the like.

Note that the transparent protecting covers 144 for the plurality of display devices 14 are contiguous to the two edge portions 151*b* of the frame 151, but that the transparent protecting covers 144 for the plurality of display devices 14 may or may not be contiguous to the respective bezel portions 142 of the plurality of display devices 14. In the present embodiment, the transparent protecting covers 144 for the plurality of display devices 14 are brought contiguous to the respective bezel portions 142 of the plurality of display devices 14. Since employing the foregoing configuration allows the four sides of each of the rectangular shaped transparent protecting covers 144 for the plurality of display devices 14 to be supported by the rectangular ring shaped bezel portion 142 of each of the plurality of display devices 14, there is an effect in allowing the transparent protecting covers 144 to become resistant to the occurrence of strain due to sagging under the weights of the electric wires 11 set on the upper surfaces of the transparent protecting covers 144 serving as the work surface, or under operators' pressing forces against the upper surfaces of the transparent protecting covers 144, or the like.

It is desirable that joined portions between adjacent ones of the transparent protecting covers 144 for the plurality of display devices 14 be located on the respective bezel portions 142 of the plurality of display devices 14. This is because if the joined portions between the adjacent ones of the transparent protecting covers 144 are laid on the respective display portions 141 of the plurality of display devices 14, it may be difficult to read in a code with a code reader 19, which will be described later. In addition, a transparent protective tape may be provided on the joined portions between the adjacent ones of the transparent protecting covers 144. The protective tape is designed to play a role in preventing the electric wire 11 to be laid out from being damaged due to interference with the end portions of the transparent protecting covers 144, in the event of an uneven surface formation at the joined portions between the adjacent ones of the transparent protecting covers 144 due to a manufacturing tolerance or the like, or in the event of the end portions of the transparent protecting covers 144 being separated from each other for some reason.

In order to suppress the eyestrain of an operator, the transparent protecting covers 144 for the plurality of display devices 14 may each be configured in such a manner as to include a blue light blocking layer that attenuates or blocks blue light having a wavelength of 380 nm to 500 nm. Further, the transparent protecting covers 144 may each be configured in such a manner as to include on their surfaces a reflection suppressing layer for suppressing the occurrence of reflected glare of external lighting or the like. Further, in the present embodiment, the transparent protecting covers 144 are made of a transparent plate-shaped member such as an acrylic or the like, but the transparent protecting covers 144 may be made of a sheet shaped transparent protective sheet, or the transparent protecting covers 144 may be configured in such a manner as to have a laminated structure using both that transparent plate-shaped member such as an acrylic or the like, and that sheet shaped transparent protective sheet. When the transparent protective sheets are used in place of the transparent protecting covers 144, the transparent protective sheets can be adhered tightly to the respective display portions 141 of the plurality of display devices 14.

Further, the work bench 15 is provided with a tray 123 configured to receive the electric wire 11 having been pulled out from the reel 121 of the electric wire stocking portion 12, or to temporarily stock the electric wire 11 with a preset electric wire length before feeding that electric wire 11 to the work surface of the work bench 15. Note that, in the present embodiment, the tray 123 is a part of the work bench 15, and is provided along the arrangement direction of the plurality of display devices 14 in such a manner as to follow the plurality of rectangular shaped display devices 14 arranged end to end in one row. In addition, in the present embodiment, the tray 123 is provided in such a manner as to follow a wire laying out operation performing operator side (a wire laying out operation work space side) edge portion (a lower edge portion in FIG. 1) of the plurality of display devices 14 (the work bench 15). That is, the tray 123 is provided in a wire laying out operation performing operator side of the wire harness producing device 10 relative to a middle portion of the plurality of display devices 14. In the present embodiment, the tray 123 is fixed to a work space-side side surface of the frame 151 of the work bench 15. This allows the electric wire 11 having been pulled out from the electric wire stocking portion 12 to be easy to handle, and therefore the efficiency of the wire laying out operation to be enhanced.

For the tray 123, in the present embodiment, the tray 123 of a V shape in shape of its cross section perpendicular to a longitudinal direction of the wire harness producing device 10 is used. Since the use of the V shaped tray 123 allows the electric wire 11 to be held in a straight state on a bottom portion of the tray 123 under the weight of the electric wire 11, the electric wire 11 is easily pulled out in a straight line. It should be noted, however, that, the cross-sectional shape of the tray 123 is not limited to the foregoing, but can be altered as appropriate. Further, the tray 123 may be configured in such a manner as to be divided into a plurality of trays in the longitudinal direction thereof, or may be configured in such a manner that one undivided tray 123 is provided for one work bench 15 or a plurality of work benches 15. Note that when the tray 123 is divided into a plurality of trays in the longitudinal direction thereof, the trays 123 may be configured in such a manner that the lengths of the trays 123 is set at a length corresponding to the length of one or more (e.g., two) work benches 15, so that it is possible to disjoin (separate) those trays 123 between the adjacent work benches 15 and 15. Employing the foregoing configuration has a facilitating effect on altering the layout of the production area within the factory.

Figure 3A:
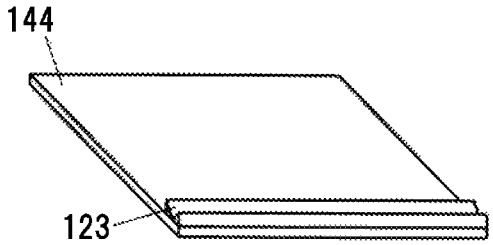
FIG. 3A is a perspective view showing a transparent protecting cover with a tray formed integrally therewith.
Figure 3B:
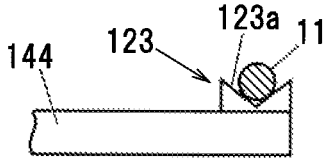
FIG. 3B is a side view showing the transparent protecting cover with the tray formed integrally therewith.
Figure 3C:
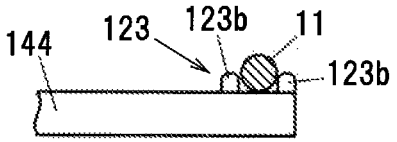
FIG. 3C is a side view showing one modification to the tray formed integrally with the transparent protecting cover.
Figure 3D:
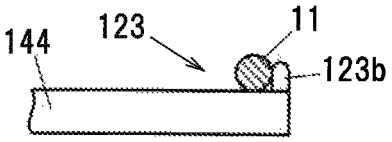
FIG. 3D is a side view showing one modification to the tray formed integrally with the transparent protecting cover.

Further, the tray 123 may be provided integrally with the transparent protecting covers 144 for the plurality of display devices 14. For example, as shown in FIGS. 3A and 3B, as the tray 123, a rod-shaped (strip-shaped) transparent member, which is made of a transparent member such as an acrylic or the like and which is formed with a V-shaped groove 123*a*, may be provided on the surface of the edge portion of the transparent protecting cover 144. In this case, the trays 123 are provided separately for each individual transparent protecting cover 144 (that is, for each display device 14). Further, as shown in FIG. 3C, the tray 123 may be configured in such a manner that one pair of linear shape protrusions 123*b* are provided parallel to each other on the edge portion of the transparent protecting cover 144. Further, as shown in FIG. 3D, the tray 123 may be configured in such a manner that one linear shape protrusion 123*b* is provided in such a manner as to follow the edge portion of the transparent protecting cover 144, so that the electric wire 11 is pulled out using that one linear shape protrusion 123*b* as a guide. Note that each of the trays 123 as shown in FIGS. 3A to 3D is formed as a separate member, provided on the transparent protecting cover 144 with an adhesive or the like, and being made integral with the transparent protecting cover 144, but that each of the trays 123 may be configured integrally with the transparent protecting cover 144 as a tray portion of the transparent protecting cover 144, by molding the transparent protecting cover 144 itself.

Returning to FIG. 1, the control device 16 is configured to include a storing section 17 that is configured to store wire laying out image data 171, operation recipe information 172, and the like. The wire laying out image data 171 is designed as image data for the wire laying out image 143 to be displayed on the plurality of display devices 14. The operation recipe information 172 is information on each of the electric wires 11 to be laid out in producing the wire harness to be produced, and is designed as a database with wire laying out order numbers (wire laying out step order numbers) of the electric wires 11 being arranged therein. Further, the operation recipe information 172 is set for each of the wire harnesses. Note that the operation recipe information 172 may not be arranged in the wire laying out operation order in the database as in the present embodiment, but that the wire laying out step numbers (in FIG. 4, "Step No.") may be stored in the database.

As shown in FIG. 4, in the operation recipe information 172, for each one of the electric wires 11 to be laid out, for example, each name (Cable name) of each one of the electric wires 11, each electric wire length (Cut Length) of each one of the electric wires 11, and each production number (Cable P/N No.) for denoting each type of each one of the electric wires 11 are configured. Further, in the operation recipe information 172, for each of respective two end portions of each one of the electric wires 11 to be laid out, each mark info (End Mark Info), which is information for identifying a terminal or a connector to which each of the respective two end portions of each one of the electric wires 11 is to be connected, each area (Area) for indicating a location for one or the other of the respective two end portions of each one of the electric wires 11 and denoting each connection destination area (e.g., each connection destination device or the like) of each one of the electric wires 11, an area label character (Area Mark Info), and the like are configured.

Further, in the present embodiment, the operation recipe information 172 is configured to include coordinate information for indicating displaying locations for an identification code (a bar code), which will be described later. The operation recipe information 172 is configured to include two pieces of coordinate information for the vicinities of the respective two end portions of each one of the electric wires 11 to be laid out. An X-From and a Y-From in FIG. 4 denote an X coordinate and a Y coordinate respectively indicating each identification code displaying location adjacent to one of the respective two end portions of each one of the electric wires 11 to be laid out. An X-To and a Y-To in FIG. 4 denote an X coordinate and a Y coordinate respectively indicating each identification code displaying location adjacent to the other one of the respective two end portions of each one of the electric wires 11 to be laid out. Hereinafter, one end portion of the electric wire 11 (in FIGS. 1 and 5A to 5C, the left end portion of the electric wire 11) will be referred to as the left end portion of the electric wire 11, while the other end portion of the electric wire 11 (in FIGS. 1 and 5A to 5C, the right end portion of the electric wire 11) will be referred to as the right end portion of the electric wire 11. The X coordinate and the Y coordinate are taken as, for example, coordinates in which the left lower end portion of each of the respective display portions 141 of the plurality of display devices 14 in FIGS. 1 and 5A to 5C is taken as the origin (0, 0), and the right direction along the longitudinal direction in FIGS. 1 and 5A to 5C is taken as the positive direction of the X coordinate while the upper direction along the transverse direction in FIGS. 1 and 5A to 5C is taken as the positive direction of the Y coordinate. Note that another point may be taken as the origin of the X coordinate and the Y coordinate, and that other directions may be taken as the positive direction of the X coordinate and the positive direction of the Y coordinate, respectively. Further, the specific contents of the operation recipe information 172 are not limited to the foregoing, but can be configured as appropriate.

The control device 16 is configured to include a displaying control section 161 configured to perform a displaying control on the plurality of display devices 14 of the work bench 15, a printing control section 163 configured to print, with two printers 18, identification marks to be attached to the respective two end portions respectively of each one of the electric wires 11, and a continuity checking section 164 that is configured to perform a continuity checking processing on each one of those electric wires 11. The control device 16 is configured in such a manner that the plurality of display devices 14 of the work bench 15, two code readers 19, the two printers 18, and two continuity checking testers 20 are connected to the control device 16.

The displaying control section 161 of the control device 16 is configured to display a full scale wire laying out image 143 on each of the plurality of display devices 14 of the work bench 15, on the basis of the wire laying out image data 171 stored in the storing section 17 of the control device 16. The wire laying out image data 171 output from the displaying control section 161 of the control device 16 is separated by means of graphics cards 167 into every two of the display devices 14, and the separated image data 171 are further separated into two each by means of separators 168 and displayed on each display portion 141 of each of the plurality of display devices 14.

In addition, in the present embodiment, the displaying control section 161 of the control device 16 is configured to look up the operation recipe information 172, and in turn display the identification codes on the plurality of display devices 14 of the work bench 15 in accordance with the wire laying out order of the electric wires 11. In addition, the displaying control section 161 of the control device 16 is configured to erase the display of the identification codes associated with the electric wires 11 having been laid out. In other words, the displaying control section 161 of the control device 16 is configured to display only the identification code associated with the electric wire 11 currently being laid out.

Figure 5A:
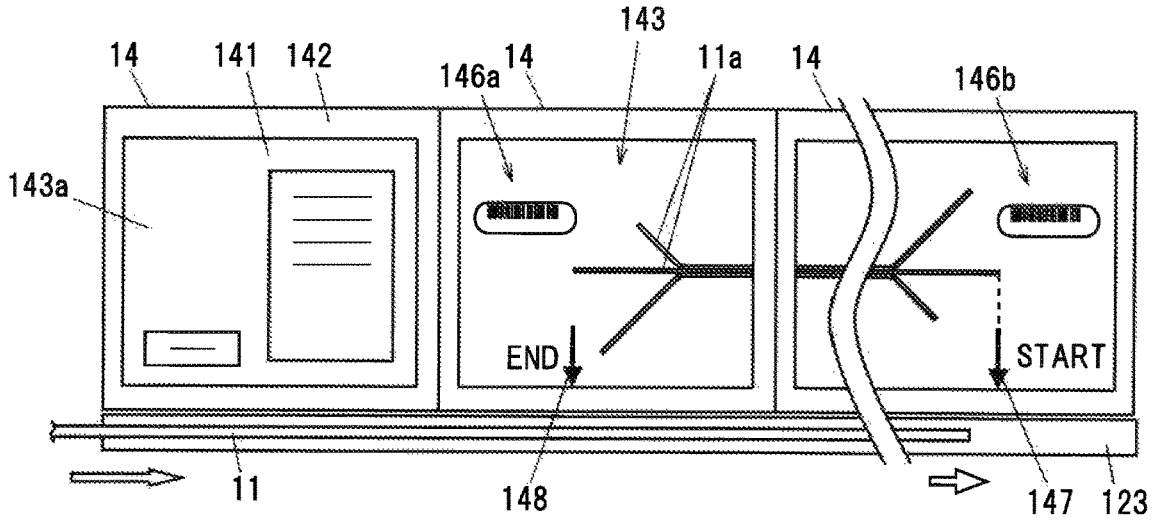
FIGS. 5A to 5C are diagrams showing display examples on a plurality of display devices.
Figure 5B:
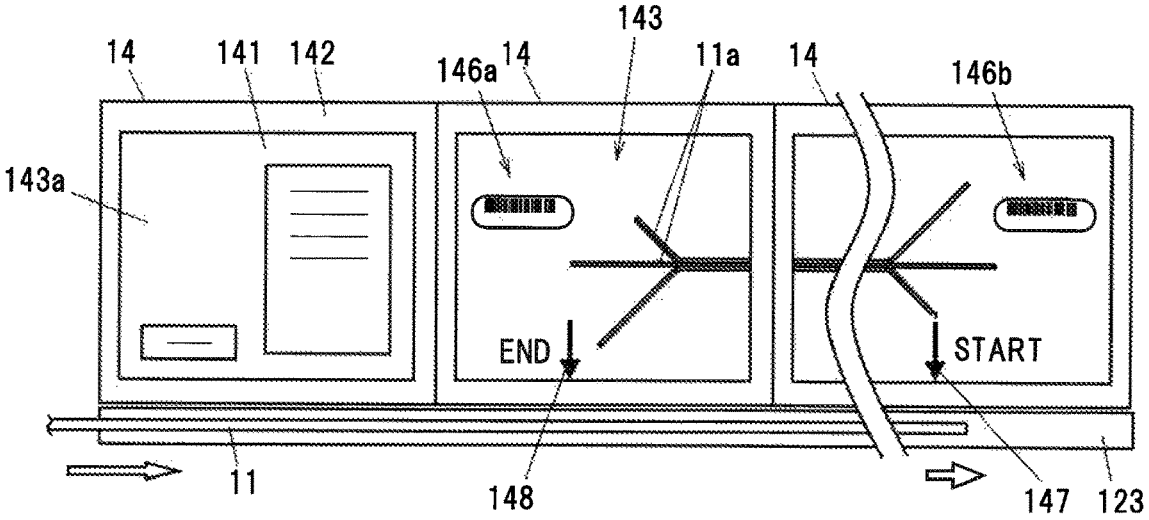
Figure 5C:
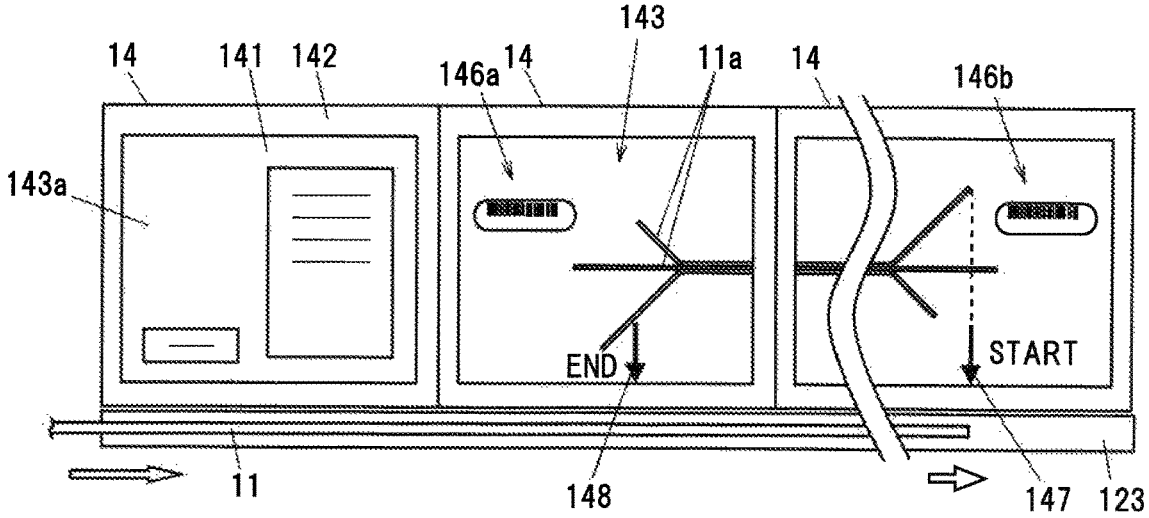

As shown in FIGS. 5A to 5C, in the present embodiment, the displaying control section 161 of the control device 16 is configured to create a bar code (a pop-up bar code) 146*a* configured to be able to identify one end portion (the left end portion in the present embodiment) of the electric wire 11 to be laid out, and display that created bar code 146*a* on the vicinity of the one end portion (the left end portion in the present embodiment) of the electric wire 11 in the wire laying out image 143 on the plurality of display devices 14. In addition, the displaying control section 161 of the control device 16 is configured to create a bar code (a pop-up bar code) 146*b* configured to be able to identify the other end portion (the right end portion in the present embodiment) of the electric wire 11 to be laid out, and display that created bar code 146*b* on the vicinity of the other end portion (the right end portion in the present embodiment) of the electric wire 11 in the wire laying out image 143 on the plurality of display devices 14. The bar code 146*a* is configured to be created from the "End Mark Info." in the FROM in FIG. 4, which is character information in the operation recipe information 172. The bar code 146*b* is configured to be created from the "End Mark Info." in the TO in FIG. 4, which is character information in the operation recipe information 172. Further, the bar codes 146*a* and 146*b* may be configured in such a manner as to be created from other information included in the operation recipe information 172, and may be configured in such a manner as to include a plurality of pieces of information. The displaying control section 161 of the control device 16 is configured to look up the operation recipe information 172, and display the bar code 146*a* for the electric wire 11 to be laid out on the displaying location (the X-From, Y-From coordinate position in FIG. 4) indicated by the coordinate information in the operation recipe information 172 in such a manner that the bar code 146*a* overlaps on the wire laying out image 143, while displaying the bar code 146*b* for the electric wire 11 to be laid out on the displaying location (the X-TO, Y-TO coordinate position in FIG. 4) indicated by the coordinate information in the operation recipe information 172 in such a manner that the bar code 146*b* overlaps on the wire laying out image 143. The bar code 146*a* to be displayed on the one end portion of the electric wire 11 in the wire laying out image 143 and the bar code 146*b* to be displayed on the other end portion of the electric wire 11 in the wire laying out image 143 are configured to be different bar codes, so that the one end portion and the other end portion of the electric wire 11 in the wire laying out image 143 are distinguished from each other. Further, the bar codes 146*a* and 146*b* may be configured in such a manner as to be created from the step No. in the operation recipe information 172. In this case, the bar code 146*a* to be displayed on the one end portion of the electric wire 11 in the wire laying out image 143 and the bar code 146*b* to be displayed on the other end portion of the electric wire 11 in the wire laying out image 143 are the same bar codes.

In this manner, in the present embodiment, the operation recipe information 172 is configured to include the two pieces of coordinate information associated with both the end portions of the electric wire 11. The displaying control section 161 of the control device 16 is configured to display the bar codes 146*a* and 146*b* as the identification codes in the displaying locations indicated by the two pieces of coordinate information, that is, in the vicinities of both the end portions of the electric wire 11 in the wire laying out image 143.

Note that the displaying control section 161 of the control device 16 may be configured in such a manner as to prestore the image information in the two bar codes 146 in the operation recipe information 172, and act to retrieve that image information in the two bar codes 146 and display the two bar codes 146*a* and 146*b* on the designated coordinates. Note that the identification codes to be displayed by the displaying control section 161 of the control device 16 are not limited to the bar codes 146*a* and 146*b*, but may be, e.g., a two-dimensional code (a QR code (registered trademark)).

The wire laying out image 143 is displayed on the plurality of display devices 14 of the work bench 15 in such a manner that the lengths of those electric wires 11 (the lengths of the electric wire images 11*a*) on the wire laying out image 143 are the full scale lengths of those electric wires 11. Note that the thicknesses of the electric wire images 11*a* may be thicker or thinner than the full scale thicknesses of the electric wires 11. By displaying the electric wire images 11*a* thicker than the full scale thicknesses of the electric wires 11, when the electric wires 11 are laid out, the electric wire images 11*a* thereof are prevented from being hidden by those electric wires 11, and so the wire laying out operation is facilitated.

In the present embodiment, the displaying control section 161 of the control device 16 is configured to include therein an electric wire end portion location displaying section 162 configured to, when each of the electric wires 11 to be laid out is pulled out, display, on the plurality of display devices 14, a starting end location indicator 147 indicating a location for a front end portion of each of the electric wires 11 having been pulled out, on the basis of the electric wire lengths of the electric wires 11 being set in the operation recipe information 172. In the present embodiment, the electric wire end portion location displaying section 162 in the displaying control section 161 of the control device 16 is configured in such a manner as to display, on the plurality of display devices 14, an ending end location indicator 148 indicating a cutting location (an ending end location) of each of the electric wires 11 having been pulled out.

This allows the operator, when manually pulling out the electric wire 11, to align the front end portion of the electric wire 11 with the starting end location indicator 147 and cut that electric wire 11 on a displaying location for the ending end location indicator 148, to thereby be easily able to produce the electric wire 11 of a specified length. Since the electric wire 11 is pulled out on the tray 123, it is desirable that the starting end location indicator 147 and the ending end location indicator 148 are displayed on the tray 123—near edge portion (the lower edge portion in FIGS. 5A to 5C) of the respective display portions 141 of the plurality of display devices 14. Note that when the trays 123 are provided integrally with the transparent protecting covers 144 as shown in FIGS. 3A to 3D, the starting end location indication 147 and the ending end location indication 148 may be displayed on locations overlapping the trays 123.

Although in the present embodiment, the starting end location indicator 147 and the ending end location indicator 148 are displayed by arrows, the starting end location indicator 147 and the ending end location indicator 148 are not limited to the foregoing, but the specific display of the starting end location indicator 147 and the ending end location indicator 148 can be altered as appropriate. Further, in order to facilitate the laying out of the electric wire 11 after cutting that electric wire 11, it is desirable that the starting end location indicator 147 and the ending end location indicator 148 are displayed adjacent to both the end portions of the electric wire image 11*a* of that electric wire 11 to be laid out. In this case, for example, on the basis of the coordinate information for the end portions of the electric wires 11 included in the operation recipe information 172 and the displaying coordinates for the bar codes 146*a* and 146*b*, for each of the electric wires 11 to be laid out, the displaying locations for the starting end location indicator 147 and the ending end location indicator 148 may be determined. That is, the displaying locations for the starting end location indicator 147 and the ending end location indicator 148 may be altered for each of the electric wires 11 to be laid out. This facilitates the wire laying out operation of the electric wires 11 after the cutting thereof.

In the present embodiment, the electric wire end portion location displaying section 162 in the displaying control section 161 of the control device 16 is configured to look up the operation recipe information 172 and display the starting end location indicator 147 on an X-TO location for the electric wire 11 to be laid out, while displaying the ending end location indicator 148 on a displaying location computed from the X-TO and the Cut Length (in the present embodiment, on a displaying location obtained by subtracting the value of the Cut Length from the value of the X-TO). That is, the displaying control section 161 of the control device 16 is configured to display the starting end location indicator 147 on a displaying location associated with one end portion (right end portion) of the electric wire 11 to be laid out, while displaying the ending end location indicator 148 on a displaying location computed from the displaying location for the starting end location indicator 147 and the electric wire length of the electric wire 11. Since this allows the displaying location for the right end portion of the n-th electric wire in the wire laying out image 143 and the starting end location indicator 147 for the n-th electric wire to be in correspondence with each other, the wire laying out operation of the electric wires 11 by the operator is facilitated. The starting end location indicator 147 and the ending end location indicator 148 are displayed on the tray 123 side edge portion of the plurality of display devices 14.

In the example of FIGS. 5A to 5C, first, when the middle electric wire 11 is laid out, as shown in FIG. 5A, the starting end location indicator 147 is displayed on a displaying location (an X-TO location) associated with the right end portion of that electric wire 11, while the ending end location indicator 148 is displayed on a displaying location obtained by subtracting the value of the Cut Length from the value of the X-TO. Note that the broken line connecting the electric wire 11 and the starting end location indicator 147 is a virtual line showing the correspondence relationship between the end portion of the electric wire 11 and the starting end location indicator 147, and is not displayed on the plurality of display devices 14. It should be noted, however, that, by displaying the broken line connecting the electric wire 11 and the starting end location indicator 147 on the plurality of display devices 14, the correspondence relationship between the end portion of the electric wire 11 and the starting end location indicator 147 may be made definite. Note that the line connecting the electric wire 11 and the starting end location indicator 147 may not be the broken line. Further, the line (the broken line or the like) connecting the left end portion of the electric wire 11 and the ending end location indicator 148 may be displayed to make definite the correspondence relationship between the left end portion of the electric wire 11 and the ending end location indicator 148.

Similarly, when the lower electric wire 11 in FIG. 5B is laid out, as shown in FIG. 5B, the starting end location indicator 147 is displayed on a displaying location (an X-TO location) associated with the right end portion of that electric wire 11, while the ending end location indicator 148 is displayed on a displaying location obtained by subtracting the value of the Cut Length from the value of the X-TO. Note that when the starting end location indicator 147 or the ending end location indicator 148 overlaps the electric wire images 11*a*, the electric wire images 11*a* may be displayed by shifting the displaying locations for the starting end location indicator 147 and the ending end location indicator 148. Similarly, when the upper electric wire 11 in FIG. 5C is laid out, as shown in FIG. 5C, the starting end location indicator 147 is displayed on a displaying location (an X-TO location) associated with the right end portion of the electric wire 11, while the ending end location indicator 148 is displayed on a displaying location obtained by subtracting the value of the Cut Length from the value of the X-TO.

Figure 6:
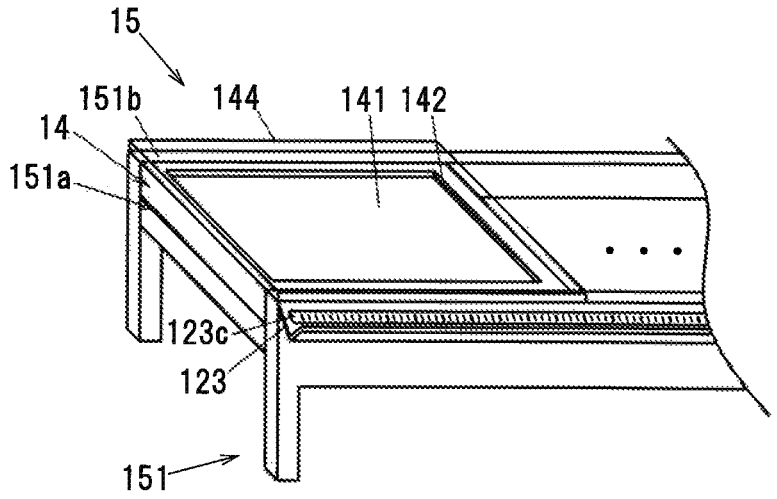
FIG. 6 is a perspective view showing the work bench including the tray provided with a dimension gauge thereon.

In addition, as shown in FIG. 6, the tray 123 may be provided with a dimension gauge (a scale showing a dimension) 123*c* to serve as a guide when the electric wire 11 is pulled out. Note that the dimension gauge 123*c* may be provided on the exterior of the tray 123, or may be displayed on the plurality of display devices 14. Further, the electric wire feeding portion 12 may be configured in such a manner as to include a means configured to be able to measure the lengths of the electric wires 11 having been pulled out from the reel 121, and in addition, may be configured in such a manner as to include a feeding out mechanism for the electric wires 11, such as a feeding device or the like.

The printing control section 163 of the control device 16 is configured to print, with the two printers 18, the identification marks to be attached to the respective two end portions, respectively, of each of those electric wires 11. In the present embodiment, the two printers 18 are arranged on both the end portions, respectively, of the work bench 15, so as to attach the identification marks to the respective two end portions, respectively, of each of those electric wires 11. Further, in the present embodiment, the two printers 18 are used to print, as the identification marks, ring marks provided with character information ("End Mark Info." in FIG. 4) thereon configured to be able to identify the connection destinations of the end portions of those electric wires 11, and mark tapes provided with two-dimensional codes (QR codes (registered trademark)) and character information ("End Mark Info." in FIG. 4) thereon configured to be able to identify the connection destinations of the end portions of those electric wires 11. Note that the two code readers 19 and the two continuity checking testers 20 are also being provided so as to be able to perform the operation at the respective two ends, respectively, of each of those electric wires 11.

Figure 7:
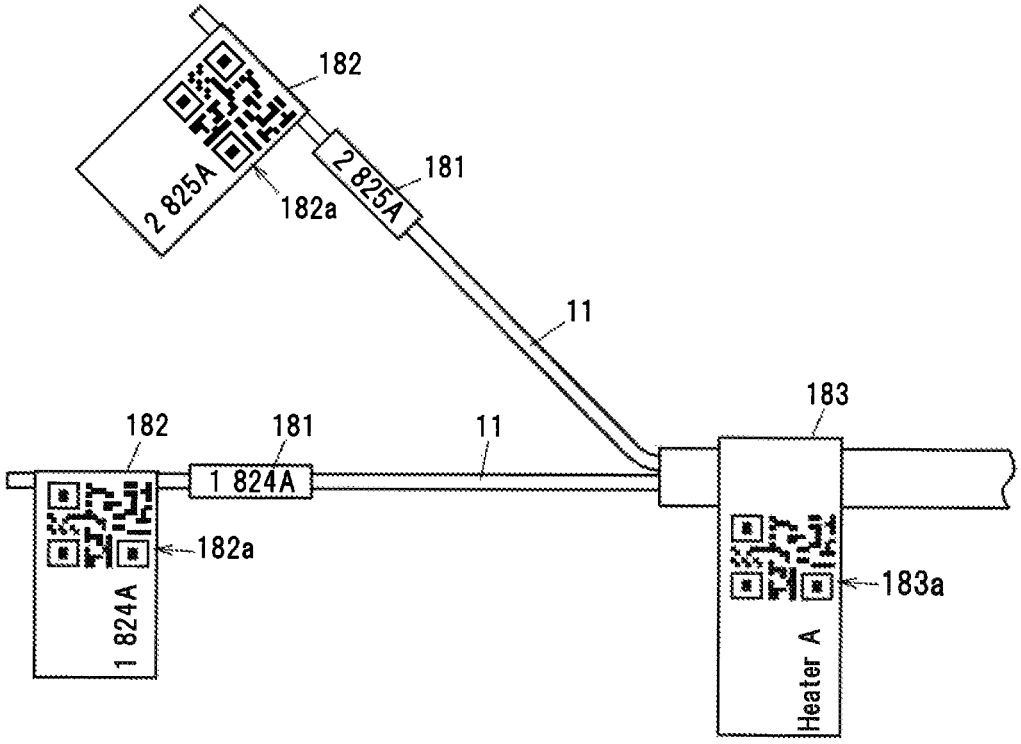
FIG. 7 is a diagram showing end portions of electric wires each being fitted with each ring mark and each mark tape thereon.

As shown in FIG. 7, the ring marks 181 and the mark tapes 182 printed by the two printers 18 are configured to be attached to the respective two end portions, respectively, of each of those electric wires 11. In the present embodiment, the mark tapes 182 are configured in such a manner that the two-dimensional codes (QR codes (registered trademark)) 182*a* are printed on the mark tapes 182 respectively, but may be configured in such a manner that the bar codes are printed on the mark tapes 182 respectively. In addition, a vicinity of a branching portion of the electric wires 11 is fitted with an area label tape 183 which is configured to indicate an area of a connection destination of the electric wires 11 extended out from that branching portion. As with the mark tapes 182, the area label tape 183 is configured in such a manner that a two-dimensional code (a QR code (registered trademark)) 183*a* and character information ("Area Mark Info." in FIG. 4) configured to be able to identify the area of the connection destination of the electric wires 11 is printed on the area label tape 183. In the present embodiment, the area label tape 183 is configured in such a manner that the two-dimensional code (QR code (registered trademark)) 183*a* is printed on the area label tape 183, but may be configured in such a manner that the bar code is printed on the area label tape 183. The mark tapes 182 and the area label tapes 183 are adhesive seals with the two-dimensional codes 182*a* and 183*a* respectively being printed thereon, and the mark tapes 182 and the area label tapes 183 are attached to each of the electric wires 11 in such a manner that their respective one parts are wrapped around each of the electric wires 11. The two-dimensional codes 182*a* on the mark tapes 182 are configured to be created from the character information ("End Mark Info." in FIG. 4) in the operation recipe information 172. The two-dimensional code 183*a* on the area label tape 183 is configured to be created from the character information ("Area Mark Info" in FIG. 4) in the operation recipe information 172. Also, the two-dimensional codes 182*a* and the two-dimensional code 183*a* may be configured in such a manner as to include a plurality of pieces of information included in the operation recipe information 172.

The ring marks 181 are a ring-shaped member, and are fitted on each of the end portions of the electric wires 11 by inserting each of the end portions of the electric wires 11 into an inner periphery of each of the ring marks 181 respectively. In the present embodiment, the inner diameters of the ring marks 181 are formed larger than the outer diameters of the electric wires 11, so that the ring marks 181 are movably fitted on each of the end portions of the electric wires 11 in longitudinal directions of each of the electric wires 11 respectively. Since the mark tapes 182 are located closer to the end portions of the electric wires 11 than the ring marks 181, the ring marks 181 movable in the longitudinal directions of the electric wires 11 are prevented from slipping off the end portions of the electric wires 11 respectively.

Note that, in the present embodiment, the ring marks 181 and the mark tapes 182 are used as the identification marks, but that the ring marks 181 may be omitted while only the mark tapes 182 may be used as the identification marks. Further, it is naturally possible to use an IC tag, an RFID tag, or the like as the identification marks. Further, the information to be printed on the mark tapes 182, the ring marks 181, and the area label tapes 183 may be printed on an outer periphery of each of the electric wires 11 (on an outer periphery of the outer sheath of each of the electric wires 11).

The continuity checking section 164 of the control device 16 is configured to check the continuity of each of the electric wires 11 after laying out of each of the electric wires 11. The continuity checking section 164 of the control device 16 is configured to perform the continuity checking by bringing the probes of the two continuity checking testers 20 into contact with the conductor of each of the electric wires 11 at both the end portions of each of the electric wires 11 to obtain the conductor resistance of each of the electric wires 11, and make a decision as to whether the conductor resistance of each of the electric wires 11 is within a predetermined normal range. In the present embodiment, the continuity checking section 164 of the control device 16 is configured in such a manner as to display an indication of the continuity checking on the plurality of display devices 14 of the work bench 15 by means of the displaying control section 161 of the control device 16 after the laying out of each of the electric wires 11, and to erase the display of the indication of the continuity checking after continuity checking of each of the electric wires 11.

Figure 8:
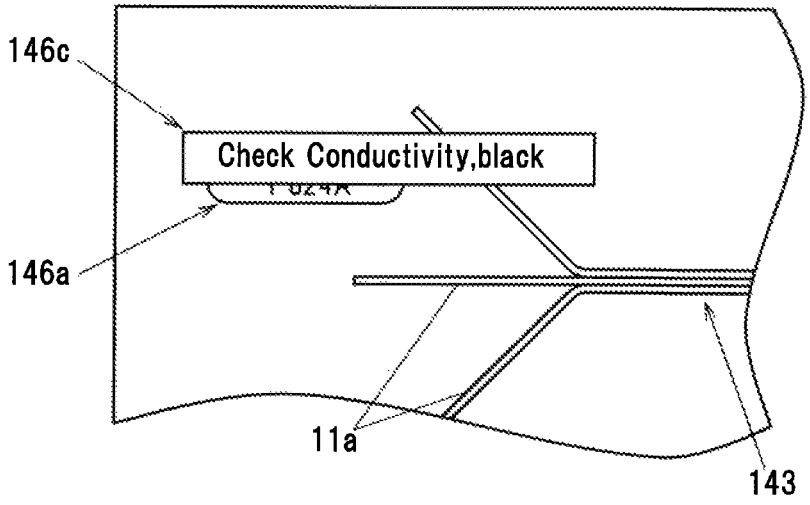
FIG. 8 is a diagram showing a display example during continuity checking operation.

As shown in FIG. 8, the continuity check indicator 146*c* is displayed in such a manner as to be partially superimposed on the bar code 146*a*, with the location of the bar code 146*a* being able to be identified by the operator, but with the bar code 146*a* being unable to be read by the operator. This makes it possible to prevent the operator from reading the bar code 146*a* and progressing to the next step before the continuity checking. Further, since a part of the bar code 146*a* can be visually recognized by the operator, it is possible to smoothly perform the reading of the bar code 146*a* after the continuity checking. In the present embodiment, a display such as a "Check Conductivity, black" is performed as the continuity check indicator 146*c*, so that it is possible to suppress the occurrence of an incorrect continuity checking by presenting the color of the electric wire 11 (the color of the outer sheath of the electric wire 11, herein, black) to be subjected to the continuity checking.

As shown in FIGS. 1 and 5A to 5C, the display device 14 being arranged closest to the reference end portion is configured to display a production information screen 143*a* with production information including the information on the wire harnesses to be produced, the information on the operator, the production procedure, and the like, to be displayed on that production information screen 143*a*, but with no images of the wire harnesses to be displayed on that production information screen 143*a*. The production information screen 143*a* may be configured as a part of the wire laying out image data 171 or may be configured in such a manner as to be created separately from the wire laying out image data 171.

Further, the control device 16 is configured to include a time recording section 165 configured to store a time at which the two bar codes 146 displayed on the plurality of display devices 14 have been read in by the two code readers 19, in the storing section 17 of the control device 16 as progress information 173. The progress information 173 is transmitted to an administrating server 21, which will be described later, and is used in the administration of the progress information. In addition, a storage section 22 of the administrating server 21 is configured in such a manner as to store production timeline information 223, which is a database configured to be able to identify types and production order numbers of the wire harnesses to be produced by each of one or more of the wire harness producing devices 10 being installed in the production area within the factory. By batch storing the production timeline information 223 of the plurality of wire harness producing devices 10 in the storage section 22 of the administrating server 21, in each of the plurality of wire harness producing devices 10, the need to alter the production timeline information is eliminated and therefore the administration of the production timeline information 223 is facilitated.

Note that production timeline information 174 may be stored in the storage section 17 of the control device 16 as well. In the present embodiment, the storage section 17 of the control device 16 is also being configured in such a manner as to store the production timeline information 174. In this case, the storage section 17 of the control device 16 is configured in such a manner as to store, as the production timeline information 174, only the information that makes it possible to identify the types and the production order numbers of the wire harnesses to be produced by the wire harness producing devices 10 to which the control device 16 is connected.

Further, the control device 16 is configured to include a correspondence decision section 166 that is configured to make a decision as to whether the code information in the identification marks (the two-dimensional codes 182*a* on the mark tapes 182) read in by the two code readers 19, and the code information in the identification codes (the bar codes 146) displayed on the plurality of display devices 14 are in correspondence with each other. In the present embodiment, the code information in the two-dimensional codes 182*a* on the mark tapes 182 and the code information in the bar codes 146 displayed on the plurality of display devices 14 are configured to match each other, and the correspondence decision section 166 of the control device 16 is configured to make a decision as to whether the code information in the two-dimensional codes 182*a* on the mark tapes 182 read in by the two code readers 19, and the code information in the bar codes 146 displayed on the plurality of display devices 14 are matching each other.

The correspondence decision section 166 of the control device 16 is configured in such a manner that, as a result of the decision made by the correspondence decision section 166, if the code information in the two-dimensional codes 182*a* on the mark tapes 182 read in by the two code readers 19, and the code information in the bar codes 146 displayed on the plurality of display devices 14 are not matching each other, then the correspondence decision section 166 displays alert information on the plurality of display devices 14 by means of the displaying control section 161 of the control device 16. Note that the correspondence decision section 166 of the control device 16 may be configured in such a manner that, for example when the code information in the two-dimensional codes 182*a* on the mark tapes 182 read in by the two code readers 19, and the code information in the bar codes 146 displayed on the plurality of display devices 14 are not matching each other, the correspondence decision section 166 activates an alarm device configured to generate an alarm with sound or light or the like, and provided adjacent to the work bench 15.

The time recording section 165 of the control device 16 is equipped with a built-in clock function, and is configured to, each time one of the plurality of electric wires 11 is laid out, store a time at which the one of the plurality of electric wires 11 has been laid out, in the storing section 17 of the control device 16. In the present embodiment, the time recording section 165 of the control device 16 is configured to store a time at which the identification codes (the bar codes 146) have been read in by the two code readers 19, in the storing section 17 of the control device 16. The time recording section 165 of the control device 16 is configured in such a manner that, as a result of the decision made by the correspondence decision section 166 of the control device 16, when the correspondence decision section 166 has determined that the code information in the two-dimensional codes 182*a* on the mark tapes 182 read in by the two code readers 19, and the code information in the bar codes 146 displayed on the plurality of display devices 14 are matching each other, the time recording section 165 stores a time at which the bar codes 146 have been read in, in the storing section 17 of the control device 16 as the progress information 173.

Note that the time at which the identification codes have been read in is not limited to the foregoing, but that the time at which the correspondence decision section 166 of the control device 16 has determined that the code information in the two-dimensional codes 182*a* on the mark tapes 182 read in by the two code readers 19, and the code information in the bar codes 146 displayed on the plurality of display devices 14 are matching each other may be stored as the time at which the identification codes have been read in. That is, the "time at which the identification codes have been read in" may not be strictly the time at which the identification codes have been read in, but the time at which the predetermined decision processing or the like resulting from the identification codes having been read in (in the present embodiment, the processing which determines that the code information in the two-dimensional codes 182*a* on the mark tapes 182 read in by the two code readers 19, and the code information in the bar codes 146 displayed on the plurality of display devices 14 are matching each other) has ended, may be stored as the "time at which the identification codes have been read in".

Further, the one or more wire harness producing devices 10 are configured to include the administrating server 21, which is provided in such a manner as to be able to communicate with the control device 16. Only one control device 16 is shown in FIG. 1, but in practice, on each of production lines (the work bench 15 of each of the production lines), the control device 16 thereof is provided, and the administrating server 21 is provided in such a manner as to be able to communicate with the control device 16 of each of the production lines.

The administrating server 21 is configured to perform the creation of the wire laying out image data and the administration of the progress information, and is configured as an appropriate combination of a computing element, a memory, an interface, a hard disk, a software and the like. The storage section 22 of the administrating server 21 is configured to store the wire laying out image data 171 and the operation recipe information 172 for all types of the wire harnesses to be produced within the factory. The administrating server 21 is configured to transmit to the control device 16 of each one of the production lines the wire laying out image data 171 and the operation recipe information 172 of the wire harnesses allocated to that one of the production lines. Further, the storage section 22 of the administrating server 21 is configured in such a manner as to store operators IDs information 222. The operators IDs information 222 is configured as a database in which operators IDs for identifying the operators having been permitted to perform the operation are pre-registered, for each of the one or more wire harness producing devices 10 installed in the production area within the factory. Note that the operators IDs information 222 may be stored in the storage section 17 of the control device 16, and that, in this case, in the operators IDs information 222, only the operators IDs for identifying the operators having been permitted to perform the operation at the wire harness producing device 10 to which that control device 16 is connected are pre-registered. When the operators IDs information 222 is stored in the storage section 17 of the control device 16, since only the operators IDs for identifying the operators having been permitted to perform the operation at the wire harness producing device 10 being connected to that control device 16 are pre-registered, the data capacity of the storage section 17 of the control device 16 can be made small. Note that, in the operators IDs information 222, operator names may be pre-registered in association with the operators IDs.

The administrating server 21 is configured to include a progress status administrating section 211. The progress status administrating section 211 of the administrating server 21 is configured to act to retrieve the time at which the identification codes have been read in, in other words, the progress information 173, having been stored in the storage section 17 of the control device 16, and store that retrieved progress information 173 in the storage section 22 of the administrating server 21, while acting to obtain a progress status of the production of the wire harness on the basis of that retrieved progress information 173, and display that obtained progress status on an administrating display (computer monitor) 23. In the present embodiment, a monitor attached to the administrating server 21 is used as the administrating display 23, but a monitor provided separately from the administrating server 21, such as a large-screen monitor provided in the factory or the like, may be used as the administrating display 23.

More specifically, the progress status administrating section 211 of the administrating server 21 is configured to, on the basis of the progress information 173, obtain the number of the laid out electric wires 11, the number of the unlaid out electric wires 11, the proportion of the number of the laid out electric wires 11 to the total number of the electric wires 11 to be laid out, a preset standard operating time (target operating time), an elapsed time from the start of the operation, and the like on each of the production lines, and display them on the administrating display 23 as a progress status display screen.

Figure 9:
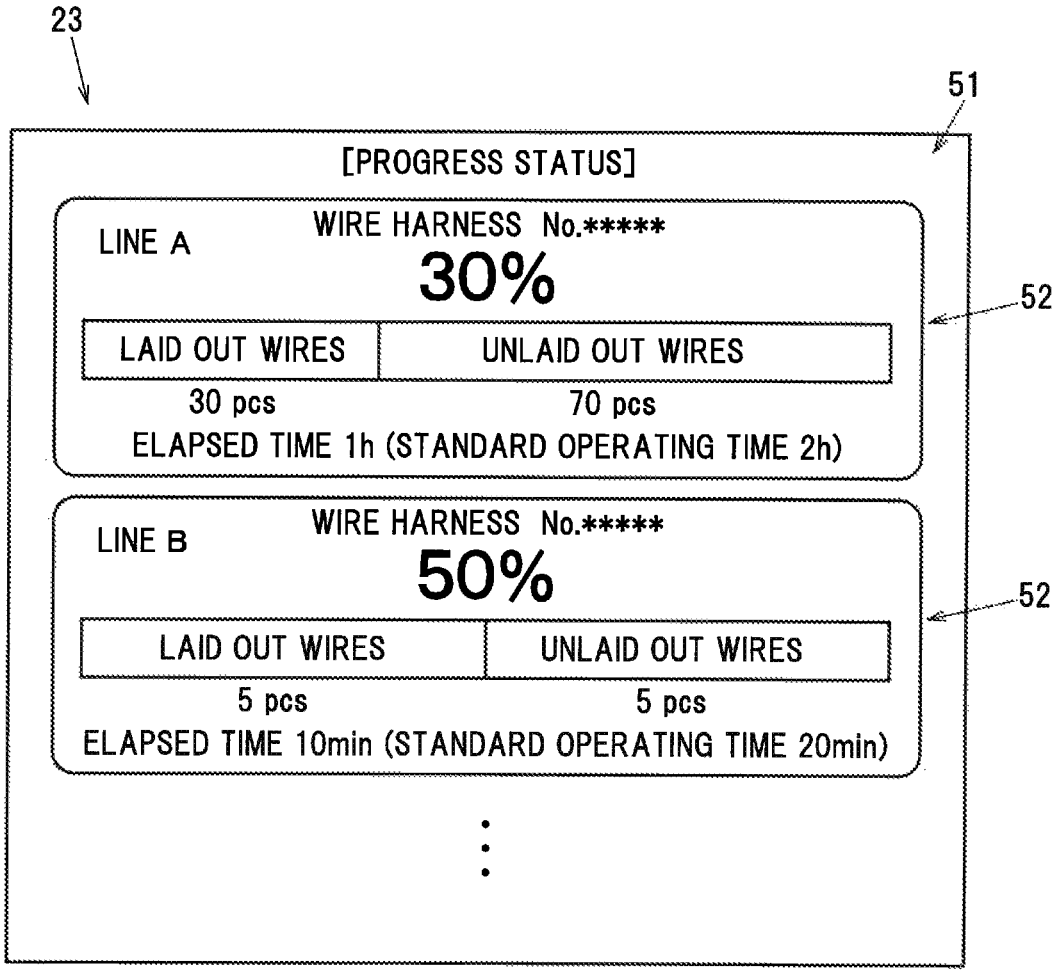
FIG. 9 is a diagram showing one example of a progress status display screen.
Figure 11:
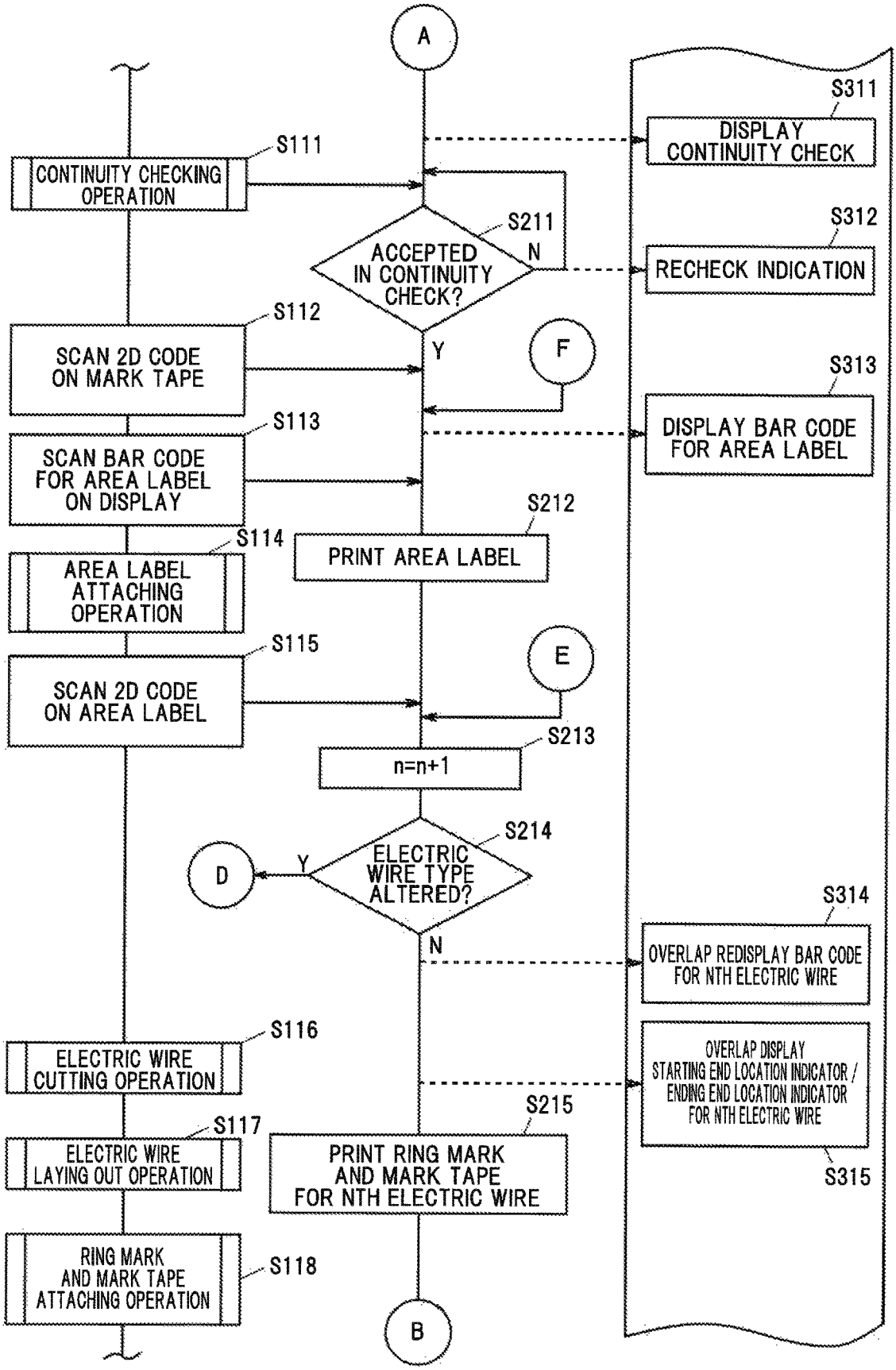
FIG. 11 is a flow chart showing a procedure for the operation flow and the control flow in producing the wire harness.

FIG. 9 shows one example of the progress status display screen 51. As shown in FIG. 9, the progress status display screen 51 is configured in such a manner as to display the progress status of each of the production lines of the factory, for example. Herein, as one example, a case is shown in which respective individual progress status displaying sections 52 of the two production lines A and B are displayed, but the number of the production lines to be displayed is not limited to the above number. Also, for the display form of each of the individual progress status displaying sections 52, various display forms can be adopted, for example by using a bar graph or a pie chart or the like to display the progress statuses. The respective display contents of each of the individual progress status displaying sections 52 are also not limited to those shown in FIG. 11, but can appropriately be configured, for example by displaying the proportion of the elapsed time to the standard operating time (target operating time), or the like.

FIGS. 10 to 13 are flow charts showing an operation flow and a control flow when a wire harness is produced by the wire harness producing device 10.

As shown in FIGS. 10 to 13, first, when the displaying control section 161 of the control device 16 is powered on, in step S301, the displaying control section 161 displays the wire laying out image 143 on the plurality of display devices 14 on the basis of the wire laying out image data 171 stored in the storage section 17 of the control device 16. At this point of time, the displaying control section 161 of the control device 16 displays the wire laying out image 143 on the plurality of display devices 14 on the basis of the wire laying out image data 171 corresponding to the wire harness of a type set in the production timeline information 174 of the storage section 17 of the control device 16. Note that the type of the wire harness to be associated with the wire laying out image data 171 for displaying the wire laying out image 143 on the display devices 14 may be able to be selected by the operator displaying a plurality of types of wire harnesses to be produced on the display devices 14 on the basis of the production timeline information 174, and using an input device such as a mouse, a keyboard or the like connected to the control device 16. After that, in step S101, the operator scans the operator ID with the code reader 19. The operator ID refers to a code allocated to each one of operators to identify that one of the operator, and is displayed on, e.g. a name tag or the like as a bar code. The information on the scanned operator ID is stored in the storage section 17 of the control device 16. The control device 16 may be configured in such a manner that, at this point of time, its displaying control section 161 displays an indication of reading in the operator ID on the plurality of display devices 14.

When the operator ID has been scanned, in step S201, the control device 16 makes a decision as to whether or not the input operator ID is the operator having been permitted to perform the operation at the wire harness producing device 10 to which the control device 16 is connected. A method to make a decision about the operators IDs is to pre-register the operators IDs in the operators IDs information 222 in the storage section 22 of the administrating server 21 and look up that operators IDs information 222, to thereby make a decision as to whether the scanned operator ID matches any one of the operators IDs being pre-registered in the operators IDs information 222. If the operator ID having been scanned in step S201 does not match any one of the operators IDs being pre-registered in the operators IDs information 222, then steps S101 and S201 are repeated until the scanned operator ID matches any one of the operators IDs being pre-registered in the operators IDs information 222. Note that, in the present embodiment, the two operators, one on the left side and one on the right side are arranged, but that the number of operators may be one or three or more. Further, in the present embodiment, only the operator ID of the left operator has been scanned, but only the operator ID of the right operator may be scanned, or the operators IDs of both the operators may be scanned.

After that, in step S202, 1 is assigned to a variable n denoting a wire laying out step number (a wire laying out order number). After that, in step S302, the displaying control section 161 of the control device 16 displays the bar codes 146*a* and 146*b* for the n-th electric wire (herein, the first electric wire), adjacent to both the end portions, respectively, of the electric wire 11 to be laid out in the wire laying out image 143, on the plurality of display devices 14, in such a manner that those bar codes 146*a* and 146*b* overlap on the wire laying out image 143. Note that the bar code 146*a* is created from the "End Mark Info." in the FROM for the Step No. corresponding to the n by looking up the operation recipe information 172, and is displayed on the X-From, Y-From coordinate position. The bar code 146*b* is created from the "End Mark Info." in the TO for the Step No. corresponding to the n by looking up the operation recipe information 172, and is displayed on the X-TO, Y-TO coordinate position.

After that, in step S102, the left operator located adjacent to the reel 121 scans the bar code 146*a* for the nth electric wire having been displayed on the plurality of display devices 14. After that, in step S203, the control device 16 identifies the production number of the nth electric wire from the bar code 146*a* for the nth electric wire on the basis of the operation recipe information 172. After that, in step S303, the displaying control section 161 of the control device 16 displays an indication of setting the reel 121 on the plurality of display devices 14. In step S103, the operator performs the setting operation for the reel 121. Note that, in the present embodiment, in step S102, only the bar code 146*a* at the left end portion located adjacent to the reel 121 has been scanned, but both of the bar codes 146*a* and 146*b* may be scanned. Further, in step S203, the production number of the n-th electric wire has been identified from the bar codes 146*a* and 146*b* for the n-th electric wire, but with S102 as a trigger, the production number of the n-th electric wire may be identified from the n representing the wire laying out step number. Further, the setting operation for the reel 121 may be performed beforehand before step S103.

After that, in step S104, the operator scans the electric wire identification code attached to the reel 121 with the code reader 19. In step S204, the control device 16 makes a decision as to whether the production number of the nth electric wire included in the information in the scanned electric wire identification code is matching the production number of the nth electric wire having been identified in step S203. If a No decision is made in step S204, then, in step S304, the displaying control section 161 of the control device 16 displays a reel replacement indication on the plurality of display devices 14 while hiding the bar codes 146*a* and 146*b* for the nth electric wire, and the flow returns to step S104.

If a Yes decision is made in step S204, then, in step S305, the displaying control section 161 of the control device 16 redisplays the bar codes 146*a* and 146*b* for the nth electric wire on the plurality of display devices 14. After that, in step S105, the operators scan the bar codes 146*a* and 146*b* for the nth electric wire having been displayed on the plurality of display devices 14. By scanning the bar codes 146*a* and 146*b* together, it is possible to check that the operators are present at the respective predetermined locations on the left side and the right side. Note that, in step S105, either the bar code 146*a* or 146*b* may be scanned. When the bar codes 146*a* and 146*b* for the n-th electric wire have been scanned, in step S306 the electric wire end portion location displaying section 162 in the displaying control section 161 of the control device 16 displays the starting end location indicator 147 and the ending end location indicator 148 on the plurality of display devices 14.

In the present embodiment, in step S306, the electric wire end portion location displaying section 162 in the displaying control section 161 of the control device 16 looks up the operation recipe information 172 and displays the starting end location indicator 147 on the X-TO location for the nth electric wire, and displays the ending end location indicator 148 on a displaying location computed from the X-TO and the Cut Length for the nth electric wire (in the present embodiment, on the displaying location obtained by subtracting the value of the Cut Length from the value of the X-TO).

After step S306, in step S106, the operators perform the electric wire cutting operation by aligning the electric wire 11 with the displayed starting end location indicator 147 and the displayed ending end location indicator 148 and cutting the electric wire 11. In the electric wire cutting operation, the operators pull out the electric wire 11 from the reel 121 onto the tray 123 up to the displaying location on which the starting end location indicator 147 is displayed, and cuts the electric wire 11 on the displaying location on which the ending end location indicator 148 is displayed.

Further, in step S205, the control device 16 prints the ring marks 181 and the mark tapes 182 at each of the two printers 18. In step S205, the control device 16 looks up the operation recipe information 172, and prints the ring marks 181 and the mark tapes 182 on the basis of each of the "End Mark Info." in the FROM and the "End Mark Info." in the TO for the Step No. corresponding to the n. More specifically, in step S205, the ring mark 181 and the mark tape 182 associated with the "End Mark Info." in the FROM are printed from the left printer 18, while the ring mark 181 and the mark tape 182 associated with the "End Mark Info." in the TO are printed from the right printer 18. In step S107, the operators perform the wire laying out operation for the electric wire 11 by using the wire laying out image 143 having been displayed on the plurality of display devices 14, and the bar codes 146*a* and 146*b* for the nth electric wire having been redisplayed in step S305 as markers and arranging the electric wire 11 (the nth electric wire) having been cut in step S105. After that, in step S108, the operators perform the attaching operation for the ring marks 181 and the mark tapes 182 to both the end portions of the electric wire 11.

After that, in step S311, the displaying control section 161 of the control device 16 displays the continuity check indicator 146*c* on the plurality of display devices 14. The operators perform the continuity checking operation in step S111. In the continuity checking operation, the operators bring the probes of the two continuity checking testers 20 into contact with the conductor of that electric wire 11 at both the end portions, respectively, of that electric wire 11 (the nth electric wire). After that, in step S211, the continuity checking section 164 of the control device 16 makes a decision as to whether an acceptance decision has been made in the continuity checking. The continuity checking section 164 of the control device 16 computes the electrical conductivity of the electric wire 11 on the basis of the outputs of the two continuity checking testers 20, and if the computed electrical conductivity of that electric wire 11 falls within a predetermined normal value range, then the continuity checking section 164 makes an acceptance decision in the continuity checking. Note that the continuity checking section 164 may be configured in such a manner as to compute the electrical resistivity of the electric wire 11 on the basis of the outputs of the two continuity checking testers 20, and that if the computed electrical resistivity falls within a predetermined normal value range, the continuity checking section 164 makes an acceptance decision in the continuity checking. If a rejection decision is made in the continuity checking (if a No decision is made in step S211), then, in step S312, the continuity checking section 164 displays a recheck indication on the plurality of display devices 14 by means of the displaying control section 161 of the control device 16, and the flow returns to step S111 to again perform the continuity checking operation. Note that the continuity checking section 164 of the control device 16 may be configured in such a manner that if that rejection decision is repeatedly made a predetermined number of times in the continuity checking in step S211, then the flow returns to step S105, to redo the laying out of the nth electric wire 11. In this case, that electric wire 11 having been rejected in the continuity checking is discarded.

After an acceptance decision has been made in the continuity checking in step S211, in step S112, the left operator performs a scanning of the two-dimensional code 182*a* on the mark tape 182 at the left end portion of the electric wire 11, while the right operator performs a scanning of the two-dimensional code 182*a* on the mark tape 182 at the right end portion of the electric wire 11. After that, in step S313, the displaying control section 161 of the control device 16 displays a bar code created from the "Area Mark Info." in the FROM on the left end portion (the X-From, Y-From coordinate position) of the nth electric wire 11 in the wire laying out image 143, while displaying a bar code created from the "Area Mark Info." in the TO on the right end portion (the X-TO, Y-TO coordinate position) of the n-th electric wire in the wire laying out image 143. In step S113, the operator on the left performs a scanning of the bar code 146*a* for an area label at the left end portion of the nth electric wire 11, while the operator on the right performs a scanning of the bar code 146*b* for an area label at the right end portion of the nth electric wire 11. After that, in step S212, the control device 16 prints the area label tapes 183 at each of the two printers 18. In step S212, the control device 16 looks up the operation recipe information 172 and prints the area label tapes 183 on the basis of the "Area Mark Info." in the FROM and the "Area Mark Info." in the TO for the Step No. corresponding to the n. More specifically, in step S212, the printer 18 on the left side prints the area label tape 183 corresponding to the "Area Mark Info." in the FROM, while the printer 18 on the right side prints the area label tape 183 corresponding to the "Area Mark Info." in the TO. In step S114, the operators perform the attaching operation for the area label tapes 183 to predetermined places on the electric wire 11, and thereafter in step S115, scan the two-dimensional codes 183*a* on the attached area labels 183.

After that, in step S213, the variable n representing the wire laying out step number (the wire laying out order number) is incremented. After that, in step S214, the control device 16 makes a decision as to whether the type of the electric wire 11 has been altered, on the basis of the operation recipe information 172. Making a decision as to whether the type of the electric wire 11 has been altered may be performed by looking up the operation recipe information 172, and comparing the production number ((Cable P/N No.) in FIG. 4) of the nth electric wire for the Step No. corresponding to the n, and the production number of the (n−1)-th electric wire for the Step No. corresponding to the (n−1).

Figure 10:
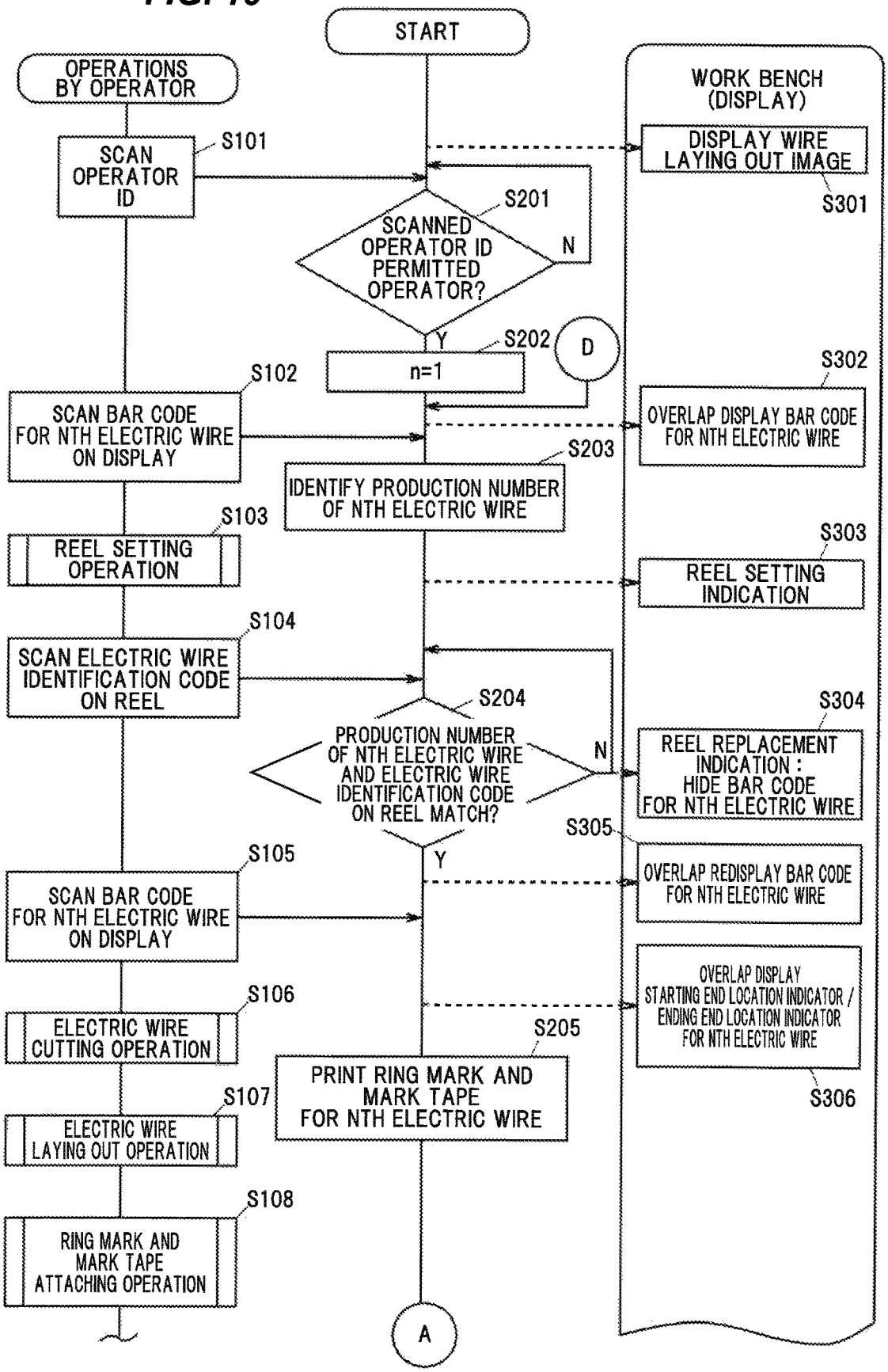
FIG. 10 is a flow chart showing a procedure for an operation flow and a control flow in producing a wire harness.

If a Yes decision is made in step S214, then the flow returns to step S302 in FIG. 10. If a No decision is made in step S214, then, in step S314, the displaying control section 161 of the control device 16 overlap displays the bar codes 146*a* and 146*b* for the nth electric wire to be nth laid out on the vicinities of both the end portions respectively of the nth electric wire. At this point of time, the control device 161 looks up the operation recipe information 172, and displays the bar codes created from the "End Mark Info." in the FROM and the "End Mark Info." in the TO for the Step No. corresponding to the n, on the X-From, Y-From coordinate position and the X-TO, Y-TO coordinate position, respectively. Further, in step S315, the electric wire end portion location displaying section 162 in the displaying control section 161 of the control device 16 displays the starting end location indicator 147 and the ending end location indicator 148 for the n-th electric wire on the plurality of display devices 14. In the present embodiment, in step S315, the electric wire end portion location displaying section 162 in the displaying control section 161 of the control device 16 looks up the operation recipe information 172 and displays the starting end location indicator 147 on the X-TO location for the n-th electric wire, and displays the ending end location indicator 148 on a displaying location computed from the X-TO and the Cut Length of the n-th electric wire (in the present embodiment, on the displaying location obtained by subtracting the value of the Cut Length from the value of the X-TO).

After step S315, in step S116, the operators perform the electric wire cutting operation by aligning the electric wire 11 with the displayed starting end location indicator 147 and the displayed ending end location indicator 148 and cutting the electric wire 11. In the electric wire cutting operation, the operators pull out the electric wire 11 from the reel 121 onto the tray 123 up to the displaying location on which the starting end location indicator 147 is displayed, and cuts the electric wire 11 on the displaying location on which the ending end location indicator 148 is displayed.

Further, in step S215, the control device 16 prints the ring marks 181 and the mark tapes 182 at each of the two printers 18. In step S215, the control device 16 looks up the operation recipe information 172, and prints the ring marks 181 and the mark tapes 182 on the basis of each of the "End Mark Info." in the FROM and the "End Mark Info." in the TO for the Step No. corresponding to the n. More specifically, in step S215, the ring mark 181 and the mark tape 182 associated with the "End Mark Info." in the FROM are printed from the left printer 18, while the ring mark 181 and the mark tape 182 associated with the "End Mark Info." in the TO are printed from the right printer 18. In step S117, the operators perform the wire laying out operation for the electric wire 11 by using the wire laying out image 143 and the identification codes (the bar codes 146*a* and 146*b*) having been displayed on the plurality of display devices 14 as markers and arranging the electric wire 11 (the nth electric wire) having been cut in step S105. After that, in step S118, the operators perform the attaching operation for the ring marks 181 and the mark tapes 182 to both the end portions of the electric wire 11.

After that, in step S321, the displaying control section 161 of the control device 16 displays the continuity check indicator 146*c* on the plurality of display devices 14. The operators perform the continuity checking operation in step S121. In the continuity checking operation, the operators bring the probes of the two continuity checking testers 20 into contact with the conductor of that electric wire 11 at both the end portions, respectively, of that electric wire 11 (the nth electric wire). After that, in step S221, the continuity checking section 164 of the control device 16 makes a decision as to whether an acceptance decision has been made in the continuity checking. The continuity checking section 164 of the control device 16 computes the electrical conductivity of the electric wire 11 on the basis of the outputs of the two continuity checking testers 20, and if the computed electrical conductivity of that electric wire 11 falls within a predetermined normal value range, then the continuity checking section 164 makes an acceptance decision in the continuity checking. Note that the continuity checking section 164 may be configured in such a manner as to compute the electrical resistivity of the electric wire 11 on the basis of the outputs of the two continuity checking testers 20, and that if the computed electrical resistivity falls within a predetermined normal value range, the continuity checking section 164 makes an acceptance decision in the continuity checking. If a rejection decision is made in the continuity checking (if a No decision is made in step S221), then, in step S322, the continuity checking section 164 displays a recheck indication on the plurality of display devices 14 by means of the displaying control section 161 of the control device 16, and the flow returns to step S121 to again perform the continuity checking operation. Note that the continuity checking section 164 of the control device 16 may be configured in such a manner that if that rejection decision is repeatedly made a predetermined number of times in the continuity checking in step S211, then the flow returns to step S314, to redo the laying out of the nth electric wire 11. In this case, that electric wire 11 having been rejected in the continuity checking is discarded.

After an acceptance decision has been made in the continuity checking in step S221 (after a Yes decision has been made in step S221), in step S222, the control device 16 looks up the operation recipe information 172 and makes a decision as to whether the n-th electric wire is the last electric wire 11 to be laid out. In step S222, the operation recipe information 172 is looked up, and a decision is made as to whether or not the production number ((Cable P/N No.) in FIG. 4) of the (n+1)-th electric wire is included in the Step No. corresponding to the n+1. Alternatively, a decision may be made on the basis of other information for the Step No. corresponding to the n+1. After that, in step S122, the operator on the left performs a scanning of the two-dimensional code 182*a* on the mark tape 182 at the left end portion of the electric wire 11, while the operator on the right performs a scanning of the two-dimensional code 182*a* on the mark tape 182 at the right end portion of the nth electric wire 11.

If a No decision is made in step S222, then, in step S223, the control device 16 looks up the operation recipe information 172, and makes a decision as to whether the electric wire 11 (the n−1th electric wire) having previously been laid out is the same in the area (the same in the "Area Mark Info." in the operation recipe information 172) as the electric wire 11 (the nth electric wire) currently being laid out, that is, the electric wire 11 having been subjected to the continuity checking in step S221. If a No decision is made in step S223, then the flow returns to step S313 in FIG. 11. If a Yes decision is made in step S223, then the flow returns to step S213 in FIG. 11.

If a Yes decision is made in step S222, that is, after the wire laying out of all of the electric wires 11 has been finished, in step S323 the displaying control section 161 of the control device 16 displays bar codes for a P/N label on the plurality of display devices 14. In step S123, the operators scan the bar codes for the P/N label displayed on the plurality of display devices. When the operators scan the bar codes for the P/N label, the control device 16 prints the P/N labels with the two printers 18 in step S224. Note that the P/N labels are a label configured to indicate a production number (a part number) of the wire harness, and to include a production number, a product name, a drawing number, and the like included in the operation recipe information 172 being printed on that label as character information and a two-dimensional code. Since the P/N labels are used to identify the entire wire harness, the P/N labels are attached to a trunk portion of the wire harness. After having attached the P/N labels to predetermined places on the wire harness in step S124, the operators scan the two-dimensional codes on the P/N labels in step S125.

After that, in step S331, the displaying control section 161 of the control device 16 displays bar codes for start of a tape wrapping operation on the plurality of display devices 14. In step S131, the operators scan the bar codes for start of the tape wrapping operation displayed on the plurality of display devices 14. At this point of time, the positions for the tape wrapping are displayed on the plurality of display devices 14. The positions for the tape wrapping are indicated by a color or a frame or the like, for example. Note that the positions for the tape wrapping may be displayed along with the wire laying out image 143 from the beginning (from the point of time of step S301). In addition, the displaying control section 161 of the control device 16 displays bar codes for finish of the tape wrapping operation on the plurality of display devices 14 in step S332. After having performed the tape wrapping operation in step S132, the operators scan the bar codes for finish of the tape wrapping operation in step S133.

When the operators have scanned the bar codes for finish of the tape wrapping operation, an incorrect electric wire detection program (Incorrect wire detection program) is started in step S231. The incorrect electric wire detection program is a program configured to check whether the operating time is excessively short or long in comparison to the preset standard operating time, and check an incorrect operating order or an operation skipping, on the basis of the operation history information (the progress information 173).

After that, the displaying control section 161 of the control device 16 displays bar codes for start of a protective material mounting operation on the plurality of display devices 14 in step S333. In step S134, the operators scan the bar codes for start of the protective material mounting operation displayed on the plurality of display devices 14. At this point of time, the positions for the protective material mounting are displayed on the plurality of display devices 14. The positions for the protective material mounting are indicated by, e.g., a color or a frame or the like. Note that the positions for the protective material mounting may be displayed along with the wire laying out image 143 from the beginning (from the point of time of step S301). In addition, the displaying control section 161 of the control device 16 displays bar codes for finish of the protective material mounting operation on the plurality of display devices 14 in step S334. After having performed the protective material mounting operation, the operators scan the bar codes for finish of the protective material mounting operation in step S136.

After that, the displaying control section 161 of the control device 16 displays bar codes for start of an inspection operation on the plurality of display devices 14 in step S335. In step S137, the operators scan the bar codes for start of the inspection operation displayed on the plurality of display devices 14. After that, the displaying control section 161 of the control device 16 displays a bar code indicating the completion of the inspection work on the plurality of display devices 14 (step S336). After having performed the predetermined inspection operation in step S139, the operators scan bar codes for finish of the inspection operation in step S141. By performing the above steps, the wire harness is produced.

The times at which the bar codes 146, or the two-dimensional codes, or the like have been scanned in each of the above steps, are stored in the storage section 17 of the control device 16 as the progress information 173 by the time recording section 165. The progress status administrating section 214 of the administrating server 21 is configured to appropriately update the progress status on the progress status display screen 51 on the basis of the progress information 173. The progress status administrating section 211 of the administrating server 21 may be configured in such a manner as to update the progress status every time the bar codes 146 or the two-dimensional codes or the like have been scanned. The progress information 173 in the storage section 22 of the administrating server 21 is updated every time new information is stored in the progress information 173 in the storage section 17 of the control device 16. Note that the progress information 173 in the storage section 22 of the administrating server 21 may be updated at the stage of having finished the step for one wire harness. Further, the progress information 173 in the storage section 22 of the administrating server 21 may be updated at regular intervals. Furthermore, the progress information 173 in the storage section 22 of the administrating server 21 may be updated when the control device 16 is powered off (at the time of shutdown).

Figure 12:
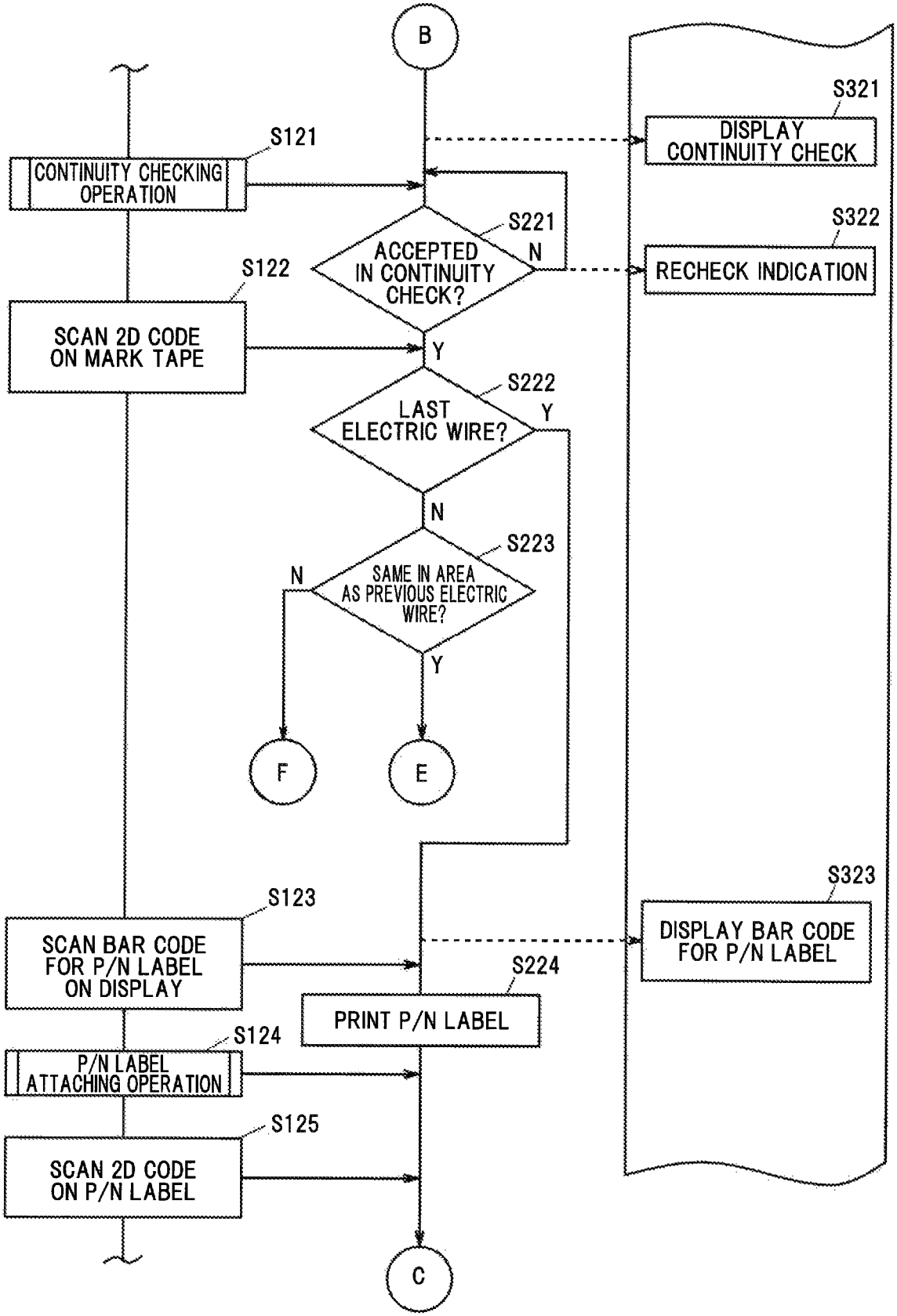
FIG. 12 is a flow chart showing a procedure for the operation flow and the control flow in producing the wire harness.
Figure 13:
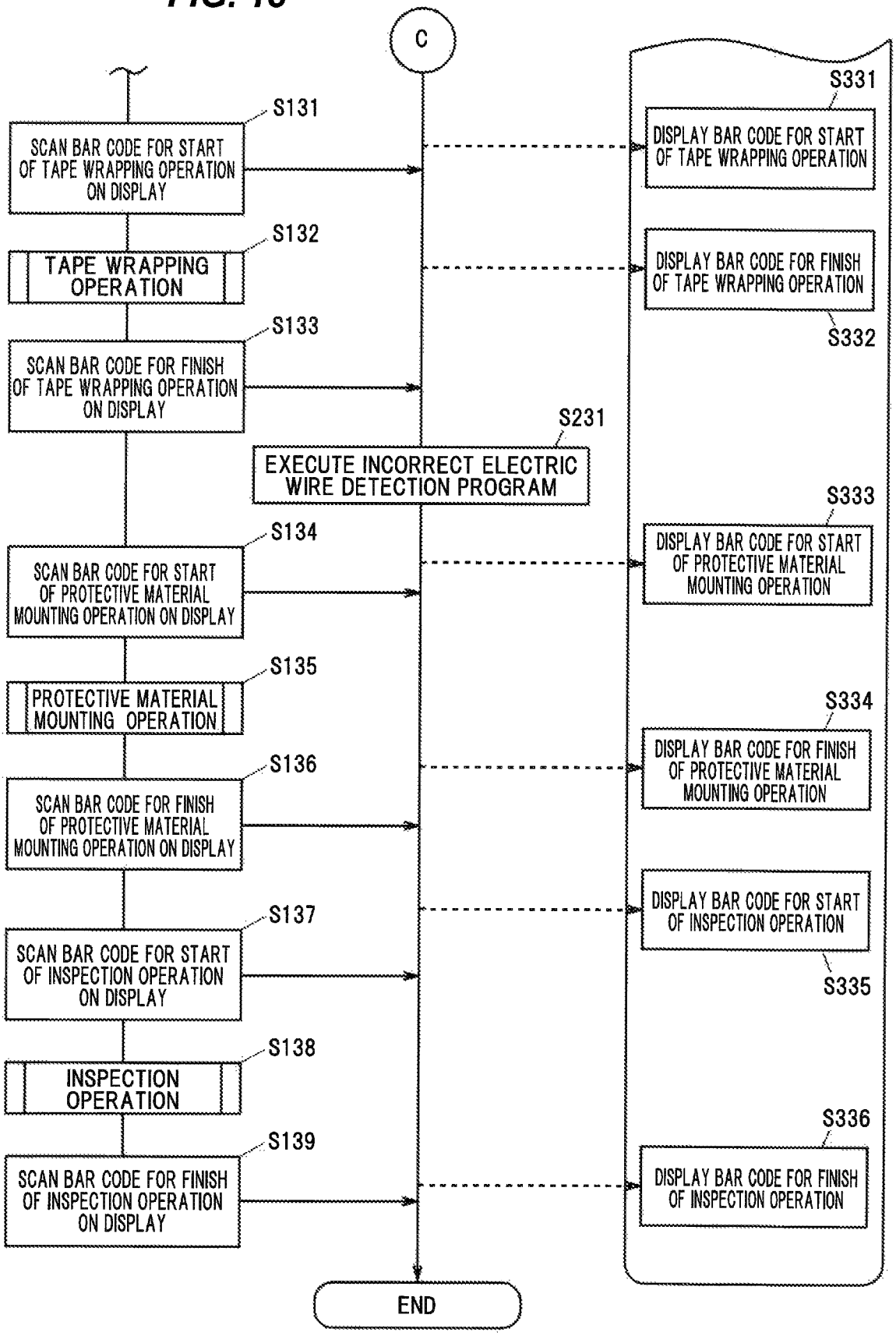
FIG. 13 is a flow chart showing a procedure for the operation flow and the control flow in producing the wire harness.

Further, the operation history information may be configured in such a manner as to be created and stored on the basis of the progress information 173 having been stored in the storage section 17 of the control device 16 or the storage section 22 of the administrating server 21. The operation history information refers to a data log configured to include the histories of the operations and the times taken for the operations summarized therein. For example, as shown in FIG. 14, the operation history information 174 is configured to include an Area for indicating a position of an end portion and denoting a connection destination area (e.g., a connection destination device or the like), an Item/Operation for denoting the electric wires 11 or the contents of the operations, a Date for denoting the times, an Additional Info for indicating details of the contents of the operations or the like, a length for denoting the electric wire lengths, the contents of the scans such as start/finish/check or the like, or a Scanned for denoting the results of the electric conductivity measurement in the continuity checking, a Time for denoting the operating times, and information such as More Info or the like for denoting other additional information. In FIG. 12, a Part Number denotes the production number of the wire harness, a Start denotes the production start time of the wire harness, a Finish denotes the production finish time of the wire harness, Operators denote the operators IDs, and a Total denotes the time taken to produce the wire harness. Note that the information included in the operation history information 174 can be altered as appropriate.

Actions and Advantageous Effects of the Embodiment

As described above, in the wire harness producing device 10 according to the present embodiment, the displaying control section 161 of the control device 16 is configured in such a manner as to, when each of the electric wires 11 to be laid out is pulled out, display, on the plurality of display devices 14, the starting end location indicator 147 indicating a location for a front end portion of each of the electric wires 11 having been pulled out, on the basis of the electric wire lengths of the electric wires 11 being set in the operation recipe information 172.

As a result, when manually feeding the electric wire 11, it is possible to efficiently perform the cutting operation for cutting the electric wire 11 to a specified electric wire length in a short time, and it is therefore possible to efficiently produce the wire harness.

(Modifications)

In the present embodiment, the starting end location indicator 147 is displayed on a displaying location (an X-TO location) associated with the right end portion of the electric wire 11 to be laid out, and the ending end location indicator 148 is displayed while the ending end location indicator 148 is displayed on a displaying location obtained by subtracting the value of the Cut Length from the value of the X-TO, but the displaying locations for the starting end location indicator 147 and the ending end location indicator 148 are not limited to the foregoing.

Figure 15A:
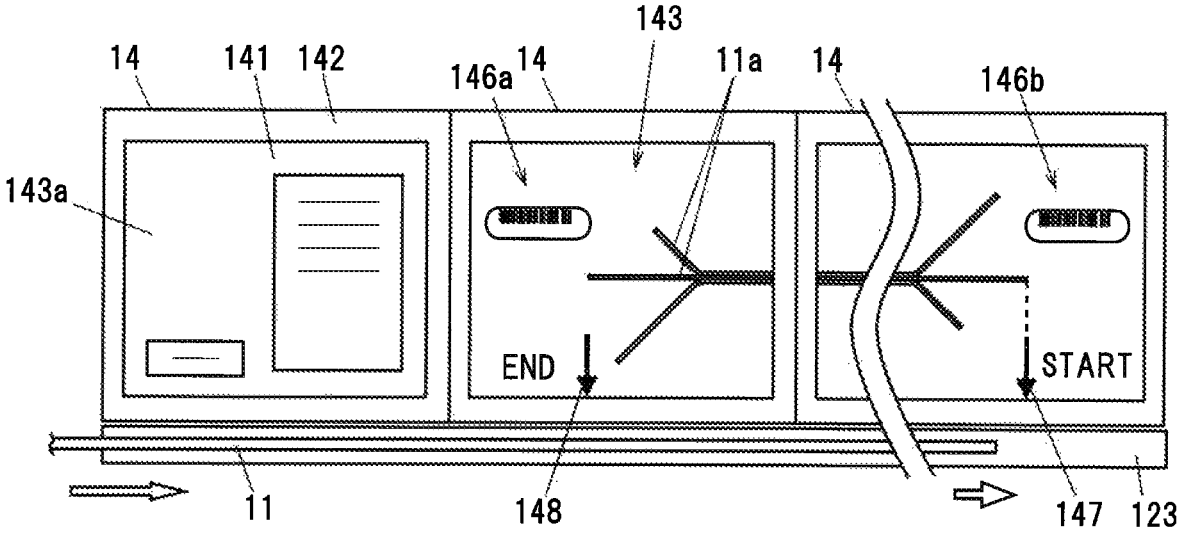
FIG. 15A is an explanatory diagram showing a modification to a displaying method for a starting end location indicator and an ending end location indicator.
Figure 15B:
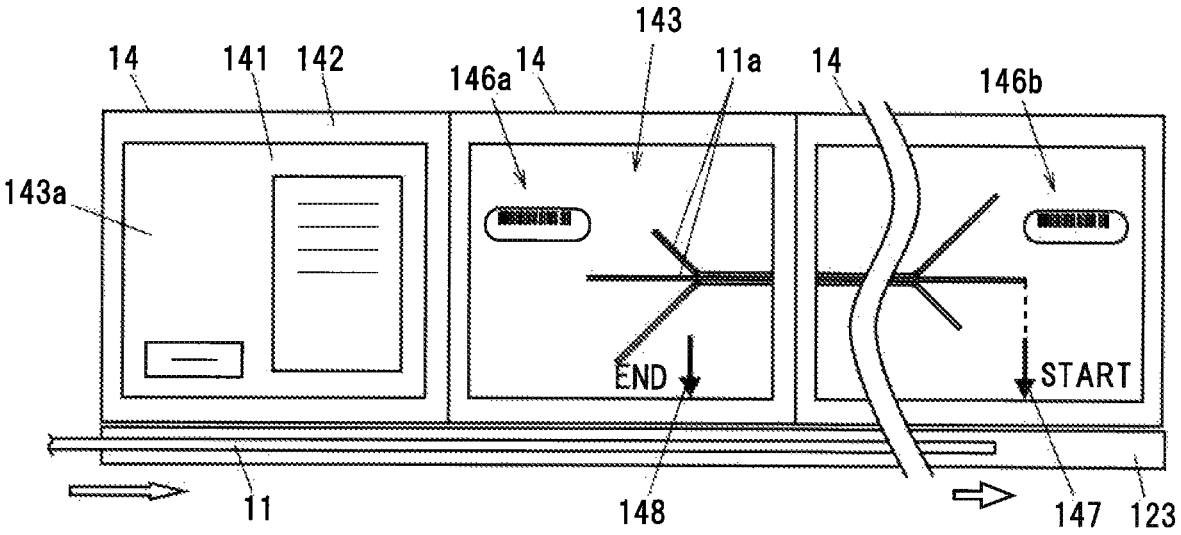
FIG. 15B is an explanatory diagram showing a modification to the displaying method for the starting end location indicator and the ending end location indicator.

For example, as shown in FIGS. 15A and 15B, the starting point location indicator 147 may be displayed on a fixed location for all of the electric wires 11. In the example of FIGS. 15A and 15B, the electric wire end portion location displaying section 162 in the displaying control section 161 of the control device 16 may be configured to look up the operation recipe information 172 and display the starting end location indicator 147 on a displaying location where the value of the X-TO is the largest, and display the ending end location indicator 148 on a displaying location computed from the displaying location where the value of the X-TO is the largest, and the Cut Length of the electric wire 11 (the n-th electric wire) to be laid out (on a displaying location obtained by subtracting the value of the Cut Length from the value of the largest X-TO). That is, the displaying control section 161 of the control device 16 is configured to display the starting end location indicator 147 on the same displaying location for all of the electric wires 11, and display the ending end location indicator 148 on a displaying location computed from the displaying location for the starting end location indicator 147, and the electric wire length of the electric wire 11 to be laid out. FIG. 15A shows the displaying locations for the starting end location indicator 147 and the ending end location indicator 148 when laying out the electric wire 11 in the middle shown, and FIG.

15B shows the displaying locations for the starting end location indicator 147 and the ending end location indicator 148 when laying out the electric wire 11 on the lower side shown. In this case, since the starting end location indicator 147 is displayed on the same displaying location regardless of the electric wire 11, pulling out the electric wire 11 in the electric wire cutting operation is facilitated. In this case, since the displaying location for the starting end location indicator 147 is fixed, the displaying location for the starting end location indicator 147 may be predetermined.

Figure 16:
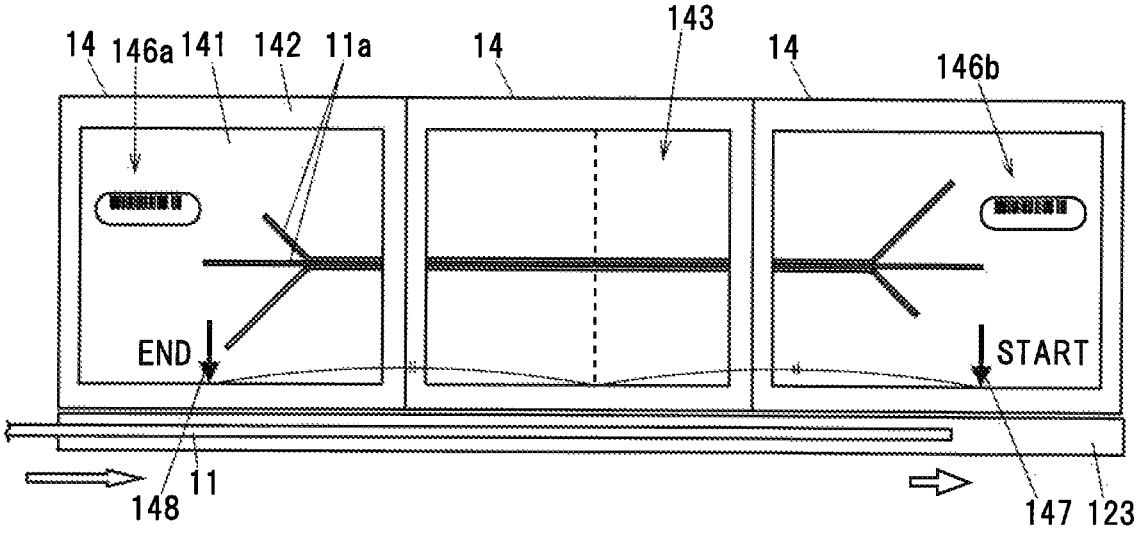
FIG. 16 is an explanatory diagram showing a modification to the displaying method for the starting end location indicator and the ending end location indicator.

Further, as shown in FIG. 16, the electric wire end portion location displaying section 162 in the displaying control section 161 of the control device 16 may be configured in such a manner as to, on the basis of a preset location of a center, display the starting end location indicator 147 and the ending end location indicator 148 from that location of the center and the Cut Length of the n-th electric wire. Specifically, the starting end location indicator 147 may be displayed on a displaying location obtained by adding half the value of the Cut Length to the value of the X coordinate at the location of the center, while the ending end location indicator 148 may be displayed on a displaying location obtained by subtracting half the value of the Cut Length from the value of the X coordinate at the location of the center. In this case, the starting end location indicator 147 and the ending end location indicator 148 are displayed on displaying locations, respectively, whose distances from the preset location of the center become equal. That is, the displaying control section 161 of the control device 16 is configured to display the starting end location indicator 147 and the ending end location indicator 148 on the displaying locations, respectively, whose distances from the preset location of the center become equal. In FIG. 16, the location of the center is indicated by a broken line, but the location of the center may or may not be displayed on the plurality of display devices 14. The location of the center may be altered according to the length of the wire harness.

Figure 17A:
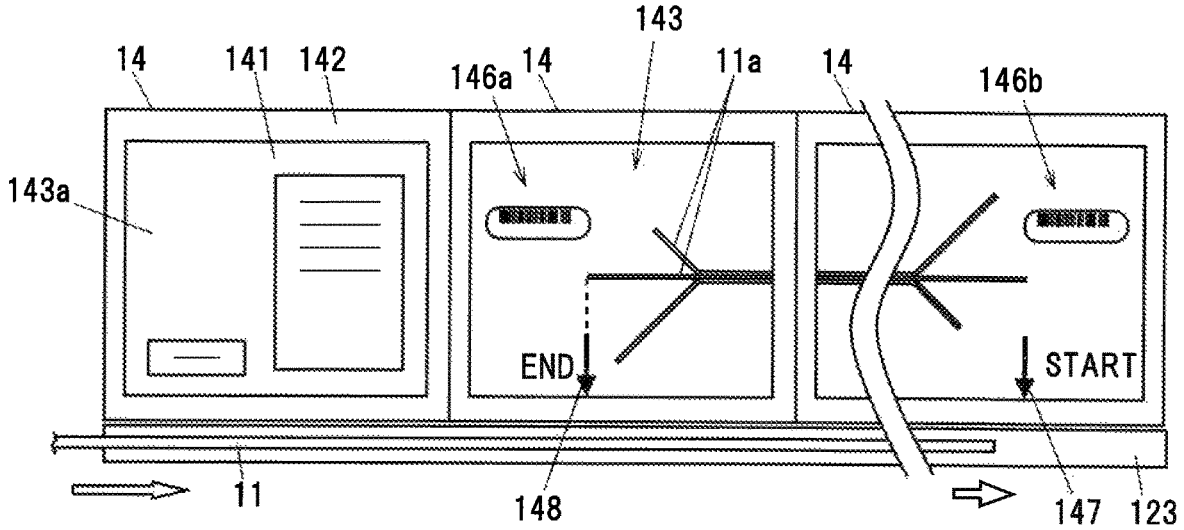
FIGS. 17A to 17C are explanatory diagrams showing a modification to the displaying method for the starting end location indicator and the ending end location indicator.
Figure 17B:
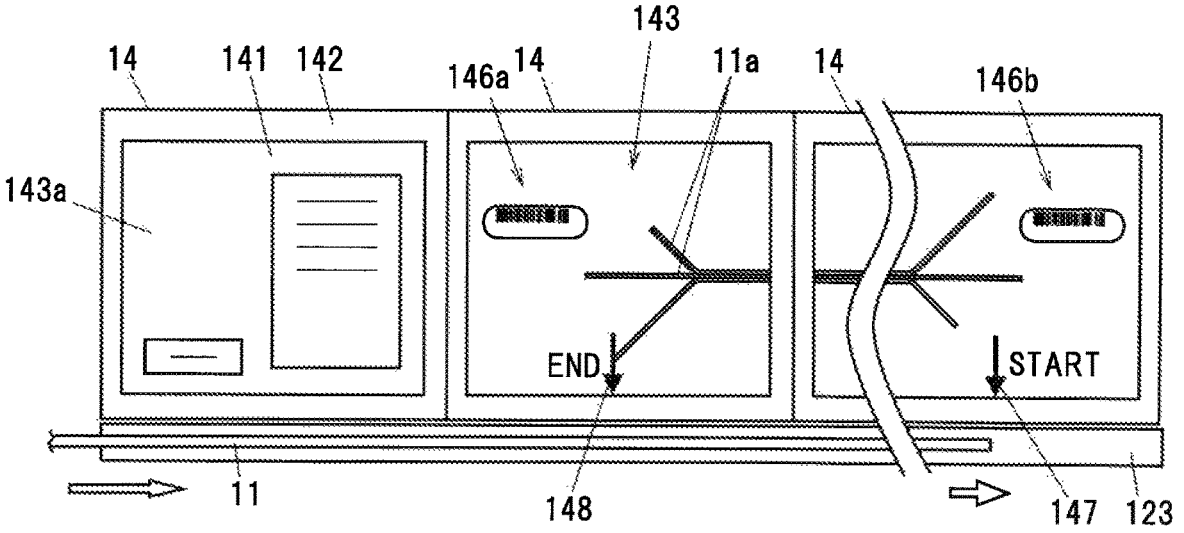
Figure 17C:
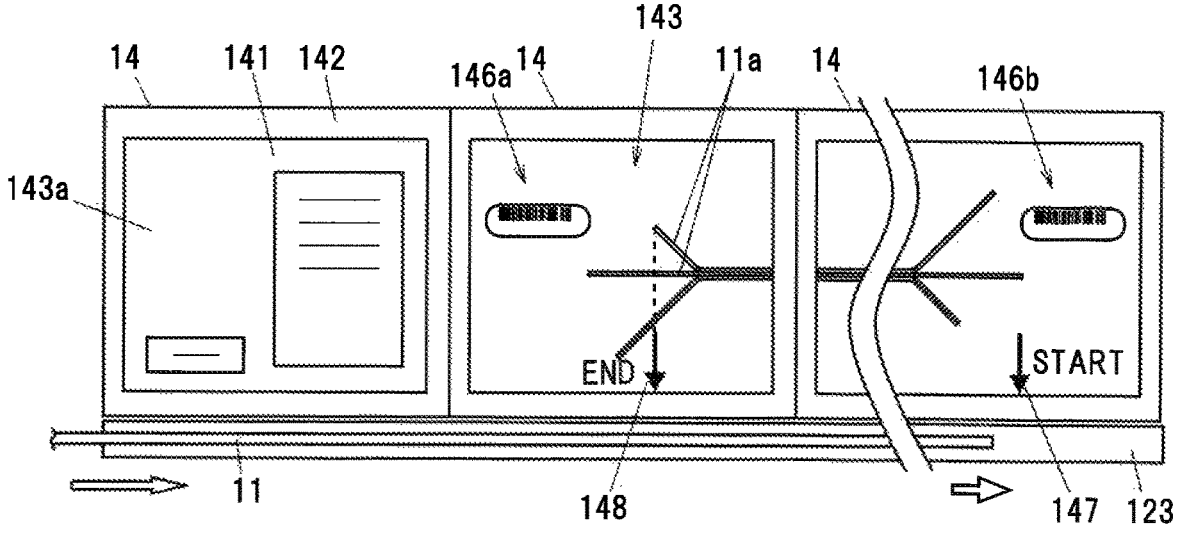

Further, as shown in FIGS. 17A to 17C, the ending end location indicator 148 may be displayed on a displaying location (an X-FROM location) associated with the left end portion of the electric wire 11 to be laid out, while the starting end location indicator 147 may be displayed on a displaying location obtained by adding the value of the Cut Length to the value of the X-FROM. FIG. 17A shows the displaying locations for the starting end location indicator 147 and the ending end location indicator 148 when laying out the electric wire 11 in the middle shown, and FIG. 17B shows the displaying locations for the starting end location indicator 147 and the ending end location indicator 148 when laying out the electric wire 11 on the lower side shown, while FIG. 17C shows the displaying locations for the starting end location indicator 147 and the ending end location indicator 148 when laying out the electric wire 11 on the upper side shown. That is, the displaying control section 161 of the control device 16 is configured to display the ending end location indicator 148 on a displaying location associated with the other end portion (left end portion) of the electric wire 11 to be laid out, and display the starting end location indicator 147 on a displaying location computed from the displaying location for the ending end location indicator 148 and the electric wire length of that electric wire 11.

Figure 18A:
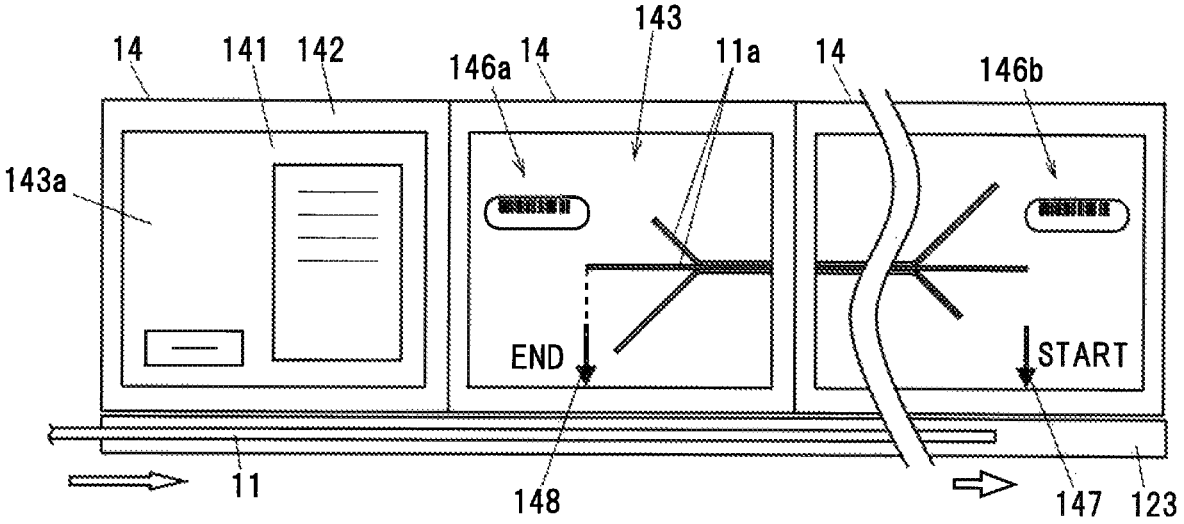
FIGS. 18A and 18B are explanatory diagrams showing a modification to the displaying method for the starting end location indicator and the ending end location indicator.
Figure 18B:
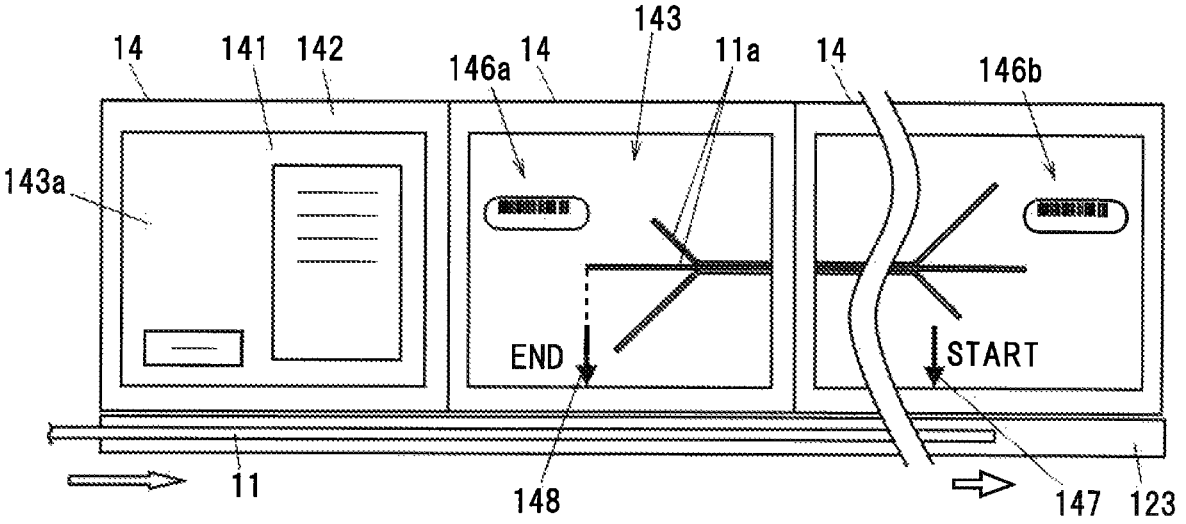

Further, as shown in FIGS. 18A and 18B, the ending end location indicator 148 may be displayed on a fixed location for all of the electric wires 11. In the example of FIGS. 18A and 18B, the displaying location for the ending end location indicator 148 is predetermined, and the starting end location indicator 147 may be displayed on a displaying location computed from the displaying location for the ending end location indicator 148 and the Cut Length of the n-th electric wire (on a displaying location obtained by adding the value of the Cut Length to the value of the X coordinate of the displaying location for the ending end location indicator 148). That is, the displaying control section 161 of the control device 16 is configured to display the ending end location indicator 148 on the same displaying location for all of the electric wires 11, and display the starting end location indicator 147 on a displaying location computed from the displaying location for the ending end location indicator 148 and the electric wire length of the electric wire 11 to be laid out. FIG. 18A shows the displaying locations for the starting end location indicator 147 and the ending end location indicator 148 when laying out the electric wire 11 in the middle shown, and FIG. 18B shows the starting end location indicator 147 and the ending end location indicator 148 when laying out the electric wire 11 on the lower side shown. In this case, since the ending end location indicator 147 is displayed on the same displaying location regardless of the electric wire 11, cutting the electric wire 11 in the electric wire cutting operation is facilitated. Further, the electric wire cutting machine may be arranged so that the electric wire 11 is cut on a location associated with the displaying location for the ending end location indicator 148. When the electric wire cutting machine is used, the ending end location indicator 148 may not be displayed.

Figure 19A:
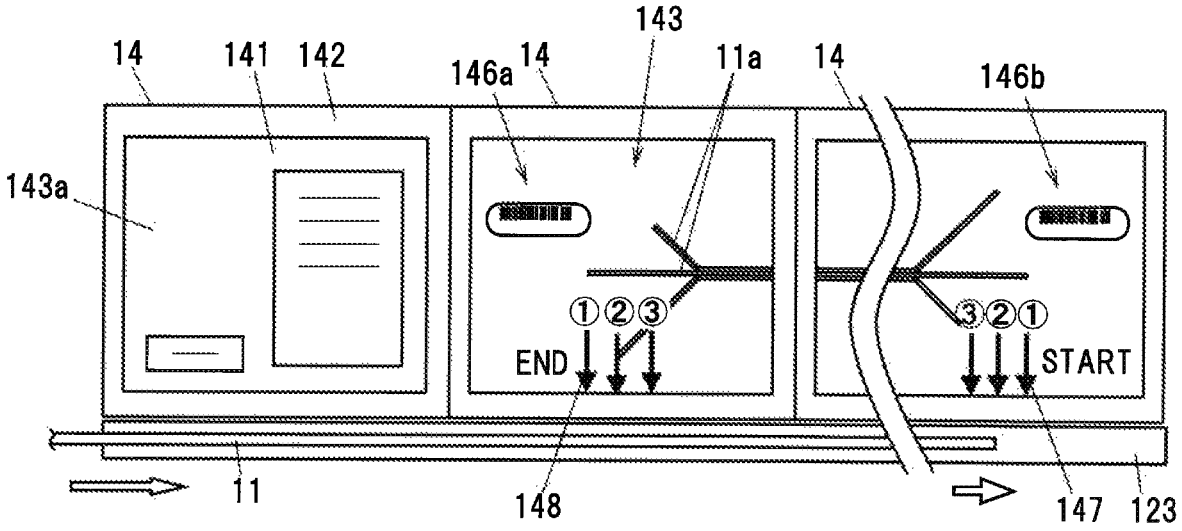
FIGS. 19A and 19B are explanatory diagrams showing a modification to the displaying method for the starting end location indicator and the ending end location indicator.

Further, as shown in FIG. 19A, the starting end location indicators 147 and the ending end location indicators 148 for all of the electric wires 11 to be laid out may be configured to be displayed together with the wire laying out order numbers. Further, the starting end location indicator 147 and the ending end location indicator 148 for the electric wire 11 currently being laid out, and the electric wire 11 to be laid out next may be configured to be displayed. For example, the starting end location indicator 147 and the ending end location indicator 148 for the electric wire 11 currently being laid out may be displayed darkly, while the starting end location indicator 147 and the ending end location indicator 148 for the electric wire 11 to be laid out next may be displayed lightly, or their colors may be changed, so that it is possible to distinguish the starting end location indicator 147 and the ending end location indicator 148 for the electric wire 11 currently being laid out, and the starting end location indicator 147 and the ending end location indicator 148 for the electric wire 11 to be laid out next.

Figure 19B:
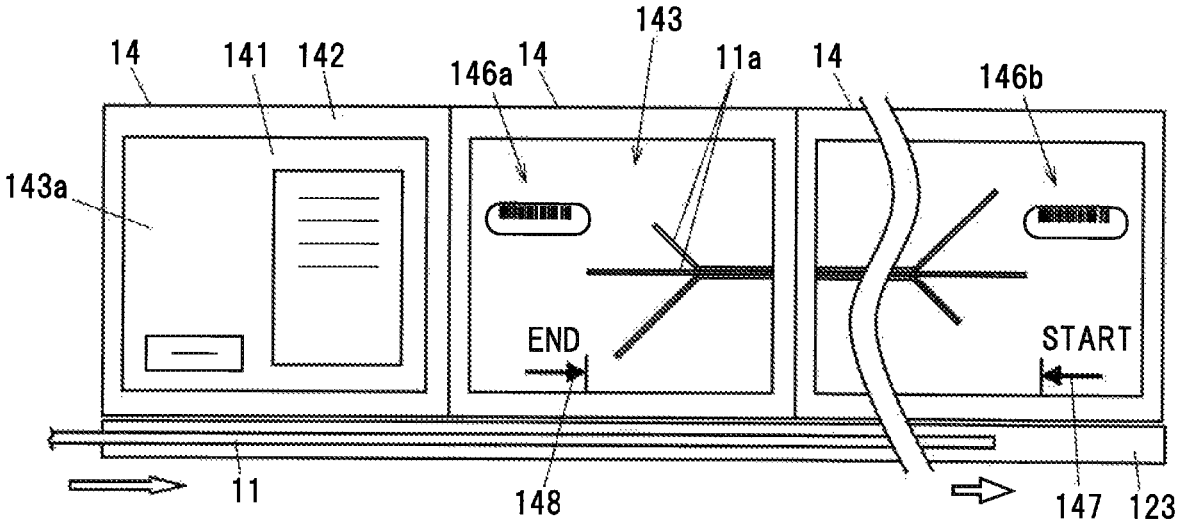

Further, although in the above-described embodiment, for the starting end location indicator 147 and the ending end location indicator 148, the arrows extending in directions (up-down directions in the drawing) perpendicular to the longitudinal direction of the wire harness are used, the present invention is not limited to the foregoing, but as shown in FIG. 19B, arrows extending in directions (left-right directions in the drawing) parallel to the longitudinal direction of the wire harness may be used. This makes it difficult for the starting end location indicator 147 or the ending end location indicator 148 and the electric wire images 11*a* to overlap. It should be noted, however, that, when displaying a plurality of the starting end location indicators 147 and a plurality of the ending end location indicators 148 at the same time, in order to reduce the display spaces for the starting end location indicators 147 and the ending end location indicators 148, for the starting end location indicators 147 and the ending end location indicator 148, it is more desirable to use arrows extending in directions (up-down directions in the drawing) perpendicular to the longitudinal direction of the wire harness.

The starting end location indicator 147 and the ending end location indicator 148 may be displayed in colors different from that of the wire laying out image 143. Further, the starting end location indicator 147 and the ending end location indicator 148 may be highlighted by blinking displaying or the like. Further, in the above embodiment, the characters such as START and END are displayed adjacent to the arrows, but characters other than START and END may be displayed, or no character may be displayed.

Summary of the Embodiment

Next, the technical ideas grasped from the above-described embodiments will be described with the aid of the reference characters and the like in the embodiments. It should be noted, however, that each of the reference characters and the like in the following descriptions is not to be construed as limiting the constituent elements in the appended claims to the members and the like specifically shown in the embodiments.

[1] A wire harness producing device (10) configured to produce a wire harness by displaying a wire laying out image (143) in a full size in a length direction on a plurality of display devices (14), and laying out electric wires (11) along the wire laying out image (143), the device (10) comprising: an electric wire feeding device (12) configured to allow the electric wires (11) to be manually pulled out; a storage section (17) configured to store operation recipe information (172) therein as a database configured to be able to identify wire laying out order numbers of the electric wires (11); and a displaying control section (161) configured to perform a displaying control on the plurality of display devices (14), with the operation recipe information (172) including electric wire lengths of the electric wires (11) being set for each of the electric wires (11), so that when each of the electric wires (11) to be laid out is pulled out, the displaying control section (161) displays, on the plurality of display devices (14), a starting end location indicator (147) indicating a location for a front end portion of each of the electric wires (11) having been pulled out, on the basis of the electric wire lengths of the electric wires (11) being set in the operation recipe information (172).

[2] The wire harness producing device (10) as defined in the above [1], wherein the displaying control section (161) is configured to display, on the plurality of display devices (14), an ending end location indicator (148) indicating a cutting location for each of the electric wires (11) having been pulled out.

[3] The wire harness producing device (10) as defined in the above [2], wherein the displaying control section (161) is configured in such a manner that when each of the electric wires (11) to be laid out is pulled out, the displaying control section (161) displays the starting end location indicator (147) on a displaying location associated with one end portion of each of the electric wires (11) to be laid out, and displays the ending end location indicator (148) on a displaying location computed from the displaying location for the starting end location indicator (147), and the electric wire lengths of the electric wires (11) to be laid out.

[4] The wire harness producing device (10) as defined in the above [2], wherein the displaying control section (161) is configured in such a manner that when each of the electric wires (11) to be laid out is pulled out, the displaying control section (161) displays the starting end location indicator (147) on a same displaying location for all of the electric wires (11) to be laid out, and displays the ending end location indicator (148) on a displaying location computed from the displaying location for the starting end location indicator (147), and the electric wire lengths of the electric wires (11) to be laid out.

[5] The wire harness producing device (10) as defined in the above [2], wherein the displaying control section (161) is configured in such a manner that when each of the electric wires (11) to be laid out is pulled out, the displaying control section (161) displays the ending end location indicator (148) on a displaying location associated with one end portion of each of the electric wires (11) to be laid out, and displays the starting end location indicator (147) on a displaying location computed from the displaying location for the ending end location indicator (148), and the electric wire lengths of the electric wires (11) to be laid out.

[6] The wire harness producing device (10) as defined in the above [2], wherein the displaying control section (161) is configured in such a manner that when each of the electric wires (11) to be laid out is pulled out, the displaying control section (161) displays the ending end location indicator (148) on a same displaying location for all of the electric wires (11), and displays the starting end location indicator (147) on a displaying location computed from the displaying location for the ending end location indicator (148), and the electric wire lengths of the electric wires (11) to be laid out.

[7] The wire harness producing device (10) as defined in the above [2], wherein the displaying control section (161) is configured to display the starting end location indicator (147) and the ending end location indicator (148) on displaying locations, respectively, whose distances from a preset location of a center become equal.

[8] The wire harness producing device (10) as defined in any one of the above [1] to [7], further comprising a tray (123) configured to receive the electric wires (11) having been pulled out, wherein the tray (123) is provided in such a manner as to follow the plurality of display devices (14) arranged end to end.

[9] The wire harness producing device (10) as defined in the above [8], wherein the tray (123) is provided in such a manner as to follow a wire laying out operation performing operator side edge portion of the plurality of display devices (14) arranged end to end.

[10] The wire harness producing device (10) as defined in the above [8] or [9], further comprising plate-shaped transparent protecting covers (144) that are provided on the plurality of display devices (14), respectively, to protect respective display portions (141) of the plurality of display devices (14), wherein the tray (123) is provided integrally with the transparent protecting covers (144).

Although the embodiments of the present invention have been described above, the above described embodiments are not to be construed as limiting the inventions according to the appended claims. Further, it should be noted that not all the combinations of the features described in the embodiments are indispensable to the means for solving the problem of the invention.

The present invention can be appropriately modified and implemented without departing from the spirit thereof. For example, although in the above-described embodiment, a case in which the wire harness designed for the train vehicle is produced has been described, the present invention is not limited to the above case, but can also produce the wire harness designed for a use application other than for the train vehicle.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A wire harness production-supporting device configured to produce a wire harness by displaying a wire laying out image in a full size in a length direction on a plurality of display devices, and laying out electric wires along the wire laying out image, the device comprising:

a computer comprising a storage section and a displaying control section;

a tray configured to receive the electric wires having been pulled out, the tray being provided along an arrangement direction of the plurality of display devices in such a manner as to follow the plurality of display devices arranged end to end;

an electric wire feeding device having a reel with the electric wire being wound therearound including a supporting member that pivotably supports the reel, configured to allow front end portions of the electric wires to be manually pulled out toward the tray, and to allow the electric wires to be manually pulled out along the arrangement direction of the plurality of display devices;

the storage section configured to store operation recipe information therein as a database configured to be able to identify wire laying out order numbers of the electric wires from an identification code; and the displaying control section configured to perform a displaying control on the plurality of display devices, with the operation recipe information including electric wire lengths of the electric wires being set for each of the electric wires, so that when each of the electric wires to be laid out is pulled out, the displaying control section displays, on the plurality of display devices, a starting end location indicator indicating a location for a front end portion of each of the electric wires having been pulled out, on the basis of the electric wire lengths of the electric wires being set in the operation recipe information, wherein the wire harness comprising a plurality of electric wires having a branching portion that branches the electric wires and extending portions each of which extends from the branching portion to an end of each of the electric wires, wherein the displaying control section is configured to display, on the plurality of display devices, an ending end location indicator indicating a cutting location for each of the electric wires having been pulled out, wherein a distance between a position of the starting end location indictor and a position of the ending end location indicator in a direction parallel to a direction of the arrangement of the plurality of display devices being computed as the electric wire length that corresponds to the electric wire length set in the operation recipe information.

2. The wire harness production-supporting device according to claim 1, wherein the displaying control section is configured in such a manner that when each of the electric wires to be laid out is pulled out, the displaying control section displays the starting end location indicator on a displaying location associated with one end portion of each of the electric wires to be laid out, and displays the ending end location indicator on a displaying location computed from the displaying location for the starting end location indicator, and the electric wire lengths of the electric wires to be laid out.

3. The wire harness production-supporting device according to claim 1, wherein the displaying control section is configured in such a manner that when each of the electric wires to be laid out is pulled out, the displaying control section displays the starting end location indicator on a same displaying location for all of the electric wires to be laid out, and displays the ending end location indicator on a displaying location computed from the displaying location for the starting end location indicator, and the electric wire lengths of the electric wires to be laid out.

4. The wire harness production-supporting device according to claim 1, wherein the displaying control section is configured in such a manner that when each of the electric wires to be laid out is pulled out, the displaying control section displays the ending end location indicator on a displaying location associated with one end portion of each of the electric wires to be laid out, and displays the starting end location indicator on a displaying location computed from the displaying location for the ending end location indicator, and the electric wire lengths of the electric wires to be laid out.

5. The wire harness production-supporting device according to claim 1, wherein the displaying control section is configured in such a manner that when each of the electric wires to be laid out is pulled out, the displaying control section displays the ending end location indicator on a same displaying location for all of the electric wires, and displays the starting end location indicator on a displaying location computed from the displaying location for the ending end location indicator, and the electric wire lengths of the electric wires to be laid out.

6. The wire harness production-supporting device according to claim 1, wherein the displaying control section is configured to display the starting end location indicator and the ending end location indicator on displaying locations, respectively, whose distances from a preset location of a center become equal.

7. The wire harness production-supporting device according to claim 1, wherein the tray is provided in such a manner as to follow the plurality of display devices arranged end to end in one row.

8. The wire harness production-supporting device according to claim 7, wherein the tray is provided in such a manner as to follow a wire laying out operation performing operator side edge portion of the plurality of display devices arranged end to end.

9. The wire harness production-supporting device according to claim 7, further comprising:

plate-shaped transparent protecting covers that are provided on the plurality of display devices, respectively, to protect respective display portions of the plurality of display devices, wherein the tray is provided integrally with the transparent protecting covers.

10. The wire harness production-supporting device according to claim 1, wherein the tray comprises a dimension gauge.

11. The wire harness production-supporting device according to claim 1, wherein the tray is provided on a wire laying out operation performing operator side of the wire harness producing device relative to a middle portion of the plurality of display devices arranged end to end.

12. The wire harness production-supporting device according to claim 1, wherein the tray includes the dimension gauge provided on an exterior of the tray.

13. The wire harness producing production-supporting device according to claim 1, wherein the tray comprises the dimension gauge that guides the electric wires to be manually pulled out.

* * * * *